US005736307A

United States Patent [19]

Bertoldi et al.

[11] Patent Number: 5,736,307

[45] Date of Patent: Apr. 7, 1998

[54] SILVER HALIDE COLOR PHOTOGRAPHIC LIGHT-SENSITIVE ELEMENTS HAVING IMPROVED IMAGE QUALITY

[75] Inventors: Massimo Bertoldi, Fossano; Antonio Poggi, Quiliano; Enzo Coraluppi, Carcare, all of Italy

[73] Assignee: Imation Corp, Oakdale, Minn.

[21] Appl. No.: 629,302

[22] Filed: Apr. 8, 1996

[30] Foreign Application Priority Data

Jun. 6, 1995 [EP] European Pat. Off. ..... 95108590

[51] Int. Cl.[6] ..... G03C 1/46

[52] U.S. Cl. ..... 430/505; 430/544; 430/557; 430/957

[58] Field of Search ..... 430/505, 544, 430/557, 957

[56] References Cited

U.S. PATENT DOCUMENTS

| | | | |
|---|---|---|---|
| 4,579,816 | 4/1986 | Ohlschlager et al. | 430/544 |
| 4,833,070 | 5/1989 | Kunitz et al. | 430/544 |
| 4,840,880 | 6/1989 | Ohlschlager et al. | 430/544 |
| 4,897,341 | 1/1990 | Odenwalder et al. | 430/544 |
| 5,021,331 | 6/1991 | Vetter et al. | 430/544 |
| 5,200,306 | 4/1993 | Odenwalder et al. | 430/544 |

FOREIGN PATENT DOCUMENTS

| | | |
|---|---|---|
| 169458 A3 | 1/1986 | European Pat. Off. . |
| 401612 A2 | 12/1990 | European Pat. Off. . |

*Primary Examiner*—Geraldine Letscher
*Attorney, Agent, or Firm*—Mark Litman

[57] ABSTRACT

Silver halide photographic element comprising a support having coated thereon red-, green- and blue-sensitive silver halide emulsion layers comprising, respectively, cyan, magenta and yellow dye-forming couplers, wherein at least one silver halide emulsion layer comprises a yellow dye-forming DIR coupler having a 1,2,4-triazolyl group attached to the coupling position, said 1,2,4-triazolyl group comprising a hydrolyzable alkoxy- or aryloxy-carbonyl group attached to a benzylthio substituent on the 1,2,4-triazolyl group.

Preferably, the yellow dye-forming DIR coupler is represented by the formula wherein $R_1$ represents an alkyl group, an aryl group or —$NHR_5$, wherein $R_5$ represents an alkyl group or an aryl group, $R_2$ represents an alkyl group or an aryl group, TIME represents a timing group, n is 0 or 1, $R_3$ represents an alkyl group or a phenyl group, and $R_4$ represents hydrogen atom or an alkyl group.

10 Claims, No Drawings

SILVER HALIDE COLOR PHOTOGRAPHIC LIGHT-SENSITIVE ELEMENTS HAVING IMPROVED IMAGE QUALITY

FIELD OF THE INVENTION

The present invention relates to silver halide color photographic light-sensitive elements containing photographic couplers and, more particularly, DIR (Development Inhibitor Releasing) couplers capable of releasing a development inhibiting compound upon reaction with the oxidation product of a developing agent.

BACKGROUND OF THE INVENTION

It is well known that color photographic light-sensitive elements, using the subtractive process for color reproduction, comprise silver halide emulsion layers selectively sensitive to blue, green and red light and associated with yellow, magenta and cyan dye-forming couplers which form (upon reaction with an oxidized primary amine type color developing agent) the complementary color thereof. For example, an acylacetanilide type coupler is used to form a yellow color image; a pyrazolone, pyrazolotriazole, cyanacetophenone or indazolone type coupler is used to form a magenta color image; and a phenol type, such as a phenol or naphthol, coupler is used to form a cyan color image.

Usually, the color photographic light-sensitive elements comprise non-diffusible couplers incorporated independently in each of the light-sensitive layers of the material (incorporated coupler materials). Therefore, a color photographic light-sensitive element usually comprises a blue-sensitive silver halide emulsion layer (or layers) which contains a yellow dye-forming coupler and which is mainly sensitive to blue light (substantially to wavelengths less than about 500 nm), a green-sensitive silver halide emulsion layer (or layers) which contains a magenta dye-forming coupler and which is mainly sensitive to green light (substantially to wavelengths of about 500 to 600 nm) and a red-sensitive silver halide emulsion layer (or layers) which contains a cyan dye-forming coupler and which is mainly sensitive to red light (substantially to wavelengths longer than about 590 nm).

It is also known to incorporate into a light-sensitive color photographic material a compound capable of releasing a development inhibitor during development upon reaction with the oxidation product of a color developing agent. Typical examples of said compounds are the DIR (Development Inhibitor Releasing) couplers containing a group having a development inhibiting property when released from the coupler. This group is introduced at the coupling position of the coupler. Examples of DIR couplers are described by C. R. Barr, J. R. Thirtle and P. W. Wittum, Photographic Science and Eng., vol. 13. pp 74–80 (1969) and ibid. pp 214–217 (1969) and in U.S. Pat. Nos. 3,227,554, 3,615,506, 3,617,291, 3,701,783, 3,933,500 and 4,149,886.

The purpose of DIR couplers is to reduce graininess and improve sharpness of the image due to intralayer or intraimage effects (that is in the same layers or the same dye image) and improve color reproduction due to interlayer or interimage effects (that is in different layers or different dye images).

It is well known that DIR couplers comprise development inhibitor moieties which diffuse out of the photographic element being processed and accumulate in the processing solution. Such accumulation ("seasoning") causes a loss of speed in color photographic elements subsequently processed in the solution. To overcome this problem, hydrolyzable inhibitor type DIR couplers have/been disclosed, such that the released inhibitor entering the processing solution hydrolyzes to a compound that has little or no influence on the development of subsequent elements developed in the same processing solution. Hydrolyzable inhibitor type DIR couplers are disclosed, for example in U.S. Pat. Nos. 4,477,563, 4,782,012, 4,937,179, 5,004,677, 5,310,642, EP 488,310 and 440,466 and JP 2,251,950. Generally, the measure of the half-life value of the decomposition of the inhibitor released from the coupler has been considered as a measure of its ability to overcome seasoning problem and provide useful inter-image effects. If the half-time value is too short, the inhibitor is converted into an inactive species (with respect to inhibition of development) in the element soon after contact with the developing solution. If the half-time value is too long, the inhibitor may not decompose in timely fashion in the developer solution and may exert a speed loss in the elements subsequently processed in the same developing solution.

U.S. Pat. Nos. 5,021,331 discloses a color photographic element comprising a coupler with a triazole ring attached to the coupling position from which the triazole ring is released during development as silver halide development inhibitor, wherein the triazole ring comprises a substituent containing a hydrolyzable group at a distance of 2 to 4 atoms from the triazole ring. While this patent describes 1,2,3-triazole and 1,2,4-triazole rings, the preponderance of those described and all those exemplified are 1,2,3-triazoles. However, those few 1,2,4-triazoles which are shown in U.S. Pat. No. 5,021,331 are inadequate from the standpoint of inhibiting properties.

To more effectively use the DIR couplers, it is desirable to provide novel DIR couplers which give high interimage effects, good sharpness and higher sensitivity, and release development inhibitors which are converted to inactive species in the developer solution.

Yellow dye-forming DIR couplers having a 1,2,4-triazole ring attached to the coupling position are described in U.S. Pat. Nos. 4,359,521, 4,579,816, 4,833,070, 4,897,341, 5,200,306, and GB 2,204,418.

SUMMARY OF THE INVENTION

The present invention relates to a multilayer color photographic element comprising a support having coated thereon red-, green- and blue-sensitive silver halide emulsion layers comprising, respectively, cyan, magenta and yellow dye-forming couplers, wherein at least one silver halide emulsion layer comprises a yellow dye-forming DIR coupler having a 1,2,4-triazolyl group attached to the coupling position, from which the 1,2,4-triazolyl group is released during development, said 1,2,4-triazolyl group comprising a hydrolyzable carboxy- or aryloxy-carbonyl group attached to a benzylthio substituent on the 1,2,4-triazolyl group, as defined by the formula (I) below.

The color photographic elements containing the yellow dye-forming DIR coupler of formula (I) provide good interimage effects and increased sensitivity.

DETAILED DESCRIPTION OF THE INVENTION

Examples of 1,2,4-triazole compounds, which can be released upon development by the yellow dye-forming DIR couplers according to the present invention to provide development inhibition, are given in the following:

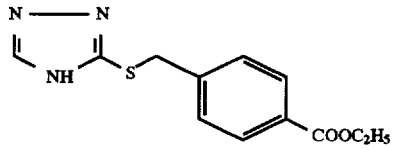

INH-1

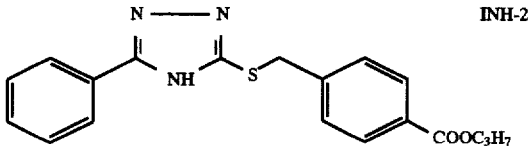

INH-2

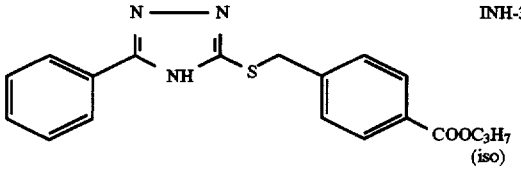

INH-3

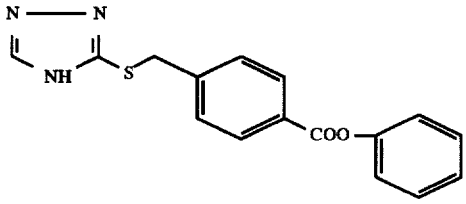

INH-4

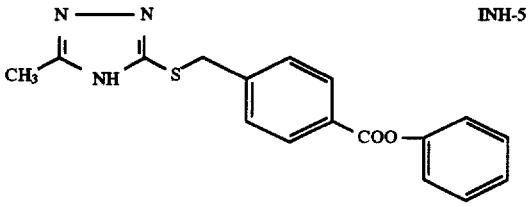

INH-5

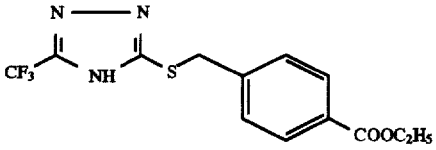

INH-6

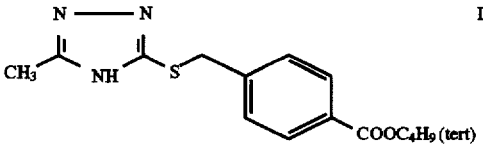

INH-7

The yellow dye-forming DIR coupler for use in the present invention may be represented by the following formula (I)

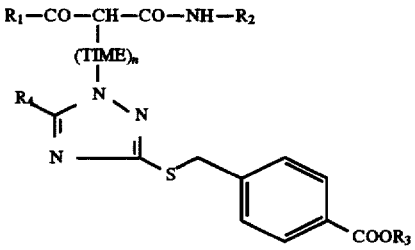

(I)

wherein $R_1$ represents an alkyl group, an aryl group or —$NHR_5$, wherein $R_5$ represents an alkyl group or an aryl group, $R_2$ represents an alkyl group or an aryl group, TIME represents a timing group, n is 0 or 1, $R_3$ represents an alkyl group or a phenyl group, and $R_4$ represents hydrogen atom or an alkyl group.

In the formula (I) above, the alkyl group represented by $R_1$, $R_2$ and $R_5$ has preferably from 1 to 18 carbon atoms and may be substituted or unsubstituted. Preferred examples of substituents of the alkyl group include an alkoxy group, an aryloxy group, a cyano, an amino group, an acylamino group, a halogen atom, an hydroxy group, a carboxy group, a sulfo group, an heterocyclic group, etc. Practical examples of useful alkyl groups are an iso-propyl group, an iso-butyl group, a tert-butyl group, an iso-amyl group, a tert-amyl group, a 1,1-dimethylbutyl group, a 1,1-dimethylhexyl group, a 1,1-diethylhexyl group, a 1,1-dimethyl-1-methoxyphenoxymethyl group, a 1,1-dimethyl-1-ethylthiomethyl group, a dodecyl group, a hexadecyl group, an octadecyl group, a cyclohexyl group, a 2-methoxyisopropyl group, a 2-phenoxyisopropyl group, an alpha-aminoisopropyl group, an alpha-succinimidoisopropyl group, etc.

The aryl group represented by $R_1$, $R_2$ and $R_5$ has preferably from 6 to 35 total carbon atoms and includes in particular a substituted phenyl group and an unsubstituted phenyl group. Preferred examples of substituents in the aryl group include a halogen atom, a nitro group, a cyano group, a thiocyano group, a hydroxy group, an alkoxy group (preferably having 1 to 15 carbon atoms, such as methoxy, isopropoxy, octyloxy, etc.), an aryloxy group (such as phenoxy, nitrophenoxy, etc.), an alkyl group (preferably having 1 to 15 carbon atoms, such as methyl, ethyl, dodecyl, etc.), an alkenyl group (preferably having 1 to 15 carbon atoms, such as allyl), an aryl group (preferably having 6 to 10 carbon atoms, such as phenyl, tolyl, etc.), an amino group (e.g. an unsubstituted amino group or an alkylamino group having 1 to 15 carbon atoms such as diethylamino, octylamino, etc.), a carboxy group, an acyl group (preferably having 2 to 16 carbon atoms such as acetyl, decanoyl, etc.), an alkoxycarbonyl group (preferably having the alkyl moiety of 1 to 20 carbon atoms, such as methoxycarbonyl, butoxycarbonyl, octyloxycarbonyl, dodecyloxycarbonyl, 2-methoxyethoxycarbonyl, etc.), an aryloxycarbonyl group (preferably having the aryl moiety of 6 to 20 carbon atoms, such as phenoxycarbonyl, tolyloxycarbonyl, tolyoxycarbonyl, etc.), a carbamoyl group (such as ethylcarbamoyl, octylcarbamoyl, etc.), an acylamino group (preferably having 2 to 21 carbon atoms, such as acetamido, octanamido, 2,4-di-tert-pentylphenoxyacetamido, etc.), a sulfo group, an alkylsulfonyl group (preferably having 1 to 15 carbon atoms, such as methylsulfonyl, octylsulfonyl, etc.), an arylsulfonyl (preferably having 6 to 20 carbon atoms, such as phenylsulfonyl, octyloxyphenylsulfonyl, etc.), an alkoxysulfonyl (preferably having 1 to 15 carbon atoms, such as methoxysulfonyl, octyloxysulfonyl, etc.), an aryloxysulfonyl (preferably having 6 to 20 carbon atoms, such as phenoxysulfonyl, etc.), a sulfamoyl group (preferably having 1 to 15 carbon atoms, such as diethylsulfamoyl, octylsulfamoyl, methyloctadecylsulfamoyl, etc.), a sulfonamino group (preferably having 1 to 15 carbon atoms, such as methylsulfonamino, octylsulfonamino, etc.) and the like.

TIME is a timing group joining the coupler residue to the 1,2,4-triazolyl group, which is released together with the 1,2,4-triazolyl group on coupling reaction with the oxidation product of a color developing agent and which, in turn, releases the 1,2,4-triazolyl group with delay under development conditions. Examples of timing groups represented by TIME in formula (I) include, for example, the following groups:

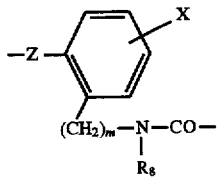

wherein Z is oxygen or sulfur and is attached to coupler moiety, m is 0 or 1, $R_8$ is hydrogen or an alkyl of 1 to 4 carbon atoms or an aryl of 6 to 10 carbon atoms, X is hydrogen, halogen, cyano, nitro, alkyl of 1 to 20 carbon atoms, alkoxy, alkoxycarbonyl, acylamino, aminocarbonyl, etc., as described in U.S. Pat. No. 4,248,962,

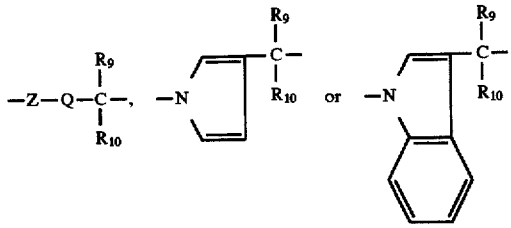

wherein the left hand side is attached to coupler moiety, Z is oxygen or sulfur or

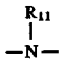

$R_9$, $R_{10}$ and $R_{11}$ are individually hydrogen, alkyl or aryl groups, and Q is a 1,2- or 1,4-phenylene or naphthylene group, as described in U.S. Pat. No. 4,409,323.

The alkyl group represented by $R_3$ and $R_4$ is preferably a lower alkyl group having 1 to 4 carbon atoms, such as methyl, ethyl, propyl, isopropyl, n-butyl, isobutyl and tert-butyl.

Preferred examples of yellow dye-forming DIR couplers according to the present invention are represented by the general formula (11)

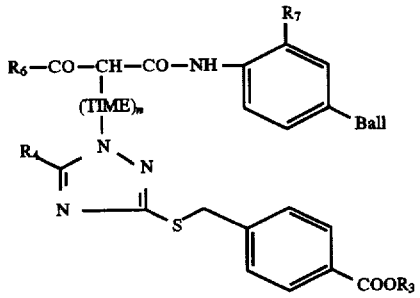

(II)

wherein $R_3$ and $R_4$ each represents a substituent as defined for formula (I), TIME and n are as defined for formula (I), $R_6$ represents an alkyl group or an aryl group, $R_7$ represents a halogen atom, an alkyl group (of 1 to 20 carbon atoms) or an aryl group (of 6 to 10 carbon atoms), and Ball is a hydrophobic ballasting group.

In the formula (II) above, the alkyl group represented by $R_6$ has preferably from 3 to 8 carbon atoms and more preferably is a branched chain alkyl group (such as, for example, an iso-propyl group, a tert-butyl group or a tert-amyl group), and the aryl group represented by $R_6$ is preferably a phenyl group optionally substituted by alkyl or alkoxy groups having 1 to 5 carbon atoms (for example, a 2- or 4-alkyl-phenyl group such as a 2-methylphenyl group, or a 2- or 4-alkoxyphenyl group such as a 2-methoxyphenyl group, a 4-isopropoxyphenyl group or a 2-butoxyphenyl group). $R_7$ represents an halogen atom (such as chlorine) or an alkyl or alkoxy group having 1 to 4 carbon atoms (such as methyl, ethyl, propyl, isoproyl, n-butyl, tert-butyl, methoxy, ethoxy, propoxy, iso-propoxy, n-butoxy and tert-butoxy groups).

In the above formula, "Ball" is a ballasting group, i.e., an organic group of such size and configuration as to render a group to which is attached non-diffusible from the layer in which is coated in a photographic element. Said ballasting group includes an organic hydrophobic residue having 8 to 32 carbon atoms bonded to the coupler either directly or through a divalent linking group such as, for example, an alkylene, imino, ether, thioether, carbonamido, sulfonamido, ureido, ester, imido, carbamoyl, and sulfamoyl group. Specific examples of suitable ballasting groups include alkyl groups (linear, branched, or cyclic), alkenyl groups, alkoxy groups, alkylaryl groups, alkylaryloxy groups, acylamidoalkyl groups, alkoxyalkyl groups, alkoxyaryl groups, alkyl groups substituted with an aryl group or a heterocyclic group, aryl groups substituted with an aryloxyalkoxycarbonyl group, and residues containing both an alkenyl or alkenyl long-chain aliphatic group and a carboxy or sulfo water-soluble group, as described, for example, in U.S. Pat. Nos. 3,337,344, 3,418,129, 4,138,258, and 4,451,559, and in GB 1,494,777.

Still preferred examples of yellow dye forming DIR couplers are represented by the general formula (III)

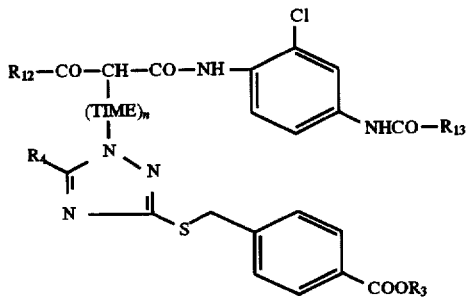

(III)

wherein $R_3$ and $R_4$ each represents a substituent as defined for formula (I), TIME and n are as defined for formula (I), $R_{12}$ represents a branched chain alkyl group, preferably a branched chain alkyl group having 3 to 8 carbon atoms (such as, for example, a isopropyl group, an isobutyl group, a tert-butyl group or a tert-amyl group), $R_{13}$ represents an alkyl group, preferably an alkyl group having 8 to 22 carbon atoms (such as, for example, a dodecyl group, a tetradecyl group, a hexadecyl group or an octadecyl group), a phenoxyalkyl group, preferably a phenoxyalkyl group having 10 to 32 carbon atoms (such as, for example, a gamma-(2,4-di-tert-amylphenoxy)propyl group), an alkoxyphenyl group preferably an alkoxyphenyl group having 10 to 32 carbon atoms, or an aralkyl group, preferably an aralkyl group having 10 to 32 carbon atoms.

When the term "group", is used in this invention to describe a chemical compound or substituent, the described chemical material includes the basic group, ring or residue and that group, ring or residue with conventional substitution. Where the term "moiety" is used to describe a chemical compound or substituent, only the unsubstituted chemical material is intended to be included. For example, "alkyl group" includes not only such alkyl moiety as methyl, ethyl, butyl, octyl, stearyl, etc., but also moieties bearing substituent groups such as halogen cyano, hydroxyl, nitro, amino, carboxylate, etc. On the other hand, "alkyl moiety" includes only methyl, ethyl, stearyl, cyclohexyl, etc.

Specific examples of yellow dye-forming DIR couplers of formula (I) for use in the present invention are illustrated below, but the present invention should not be construed as being limited thereto.

I-1

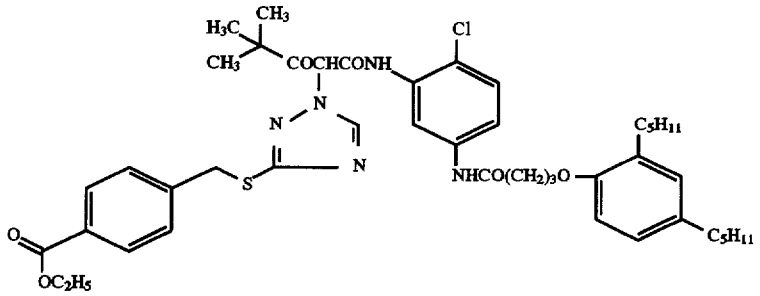

I-2

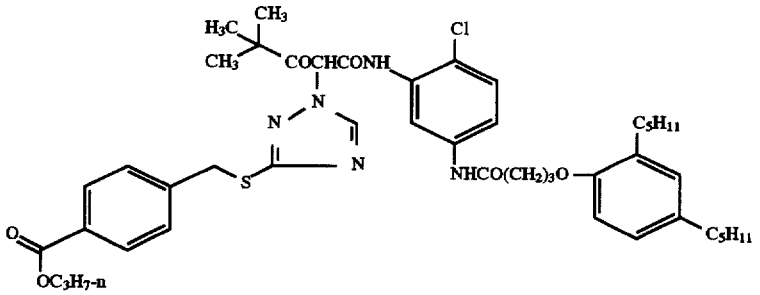

I-3

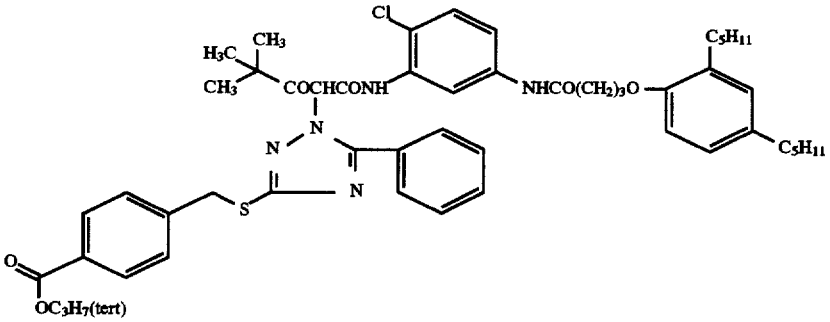

I-4

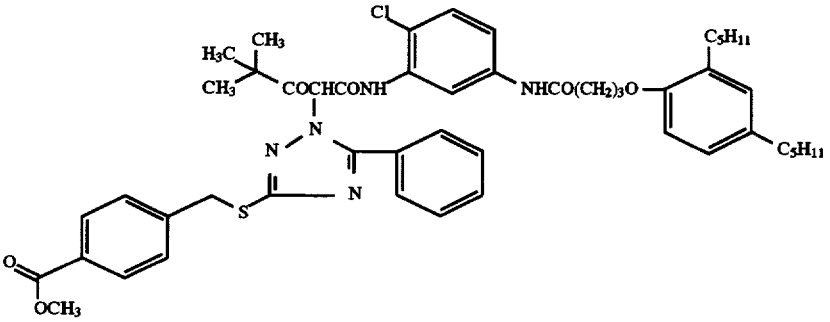

-continued
I-5
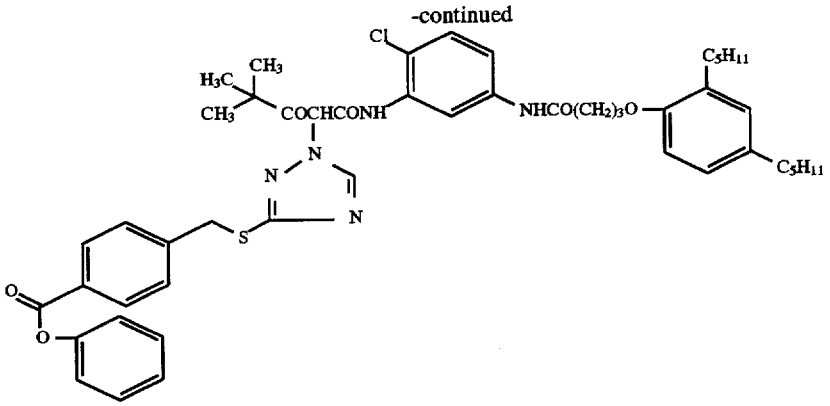
I-6
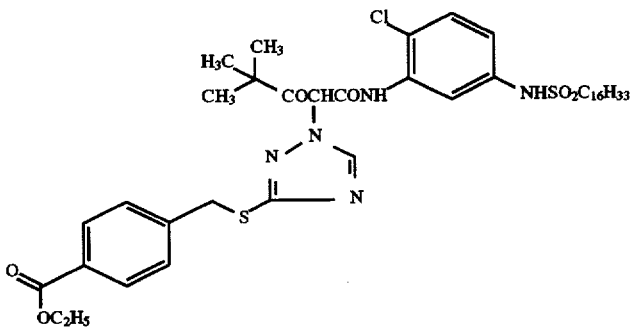
I-7
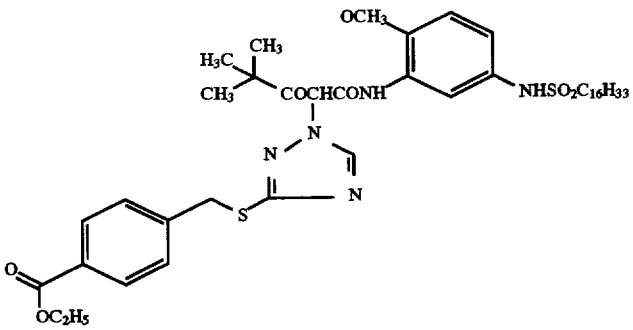
I-8
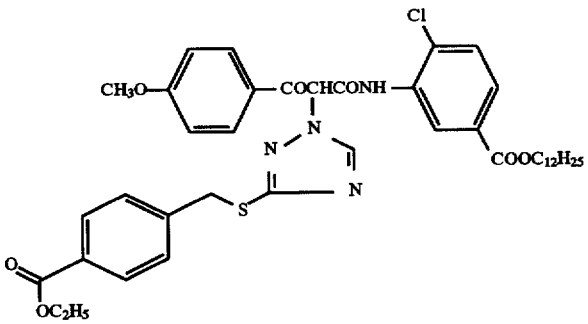
I-9
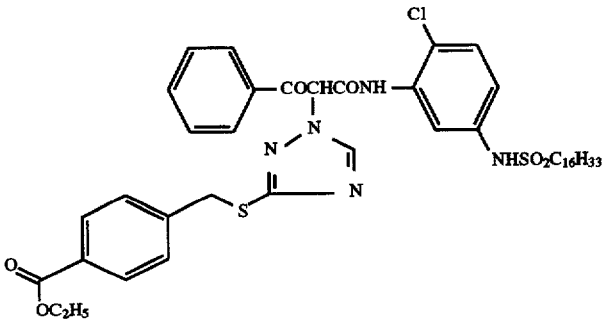

-continued
I-10
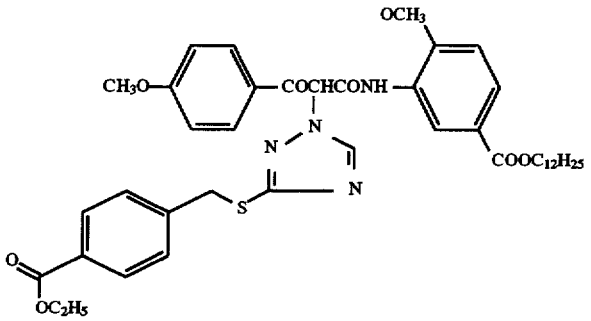
I-11
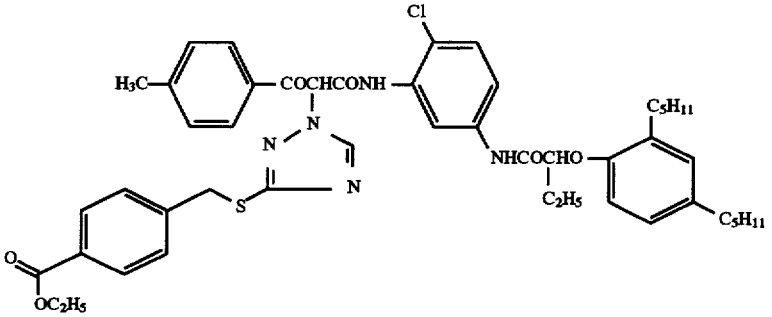
I-12
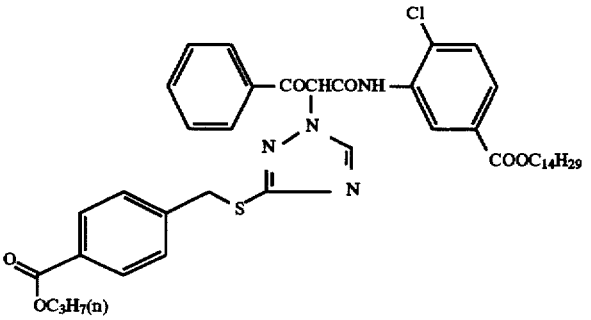
I-13
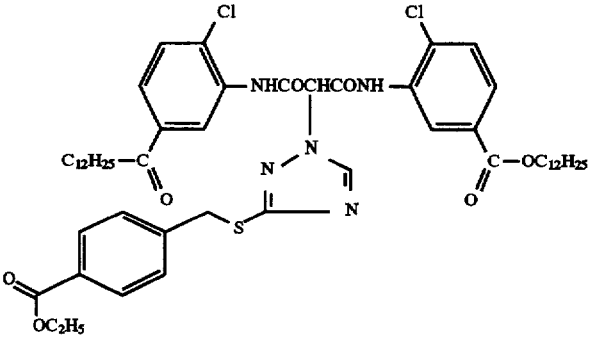
I-14
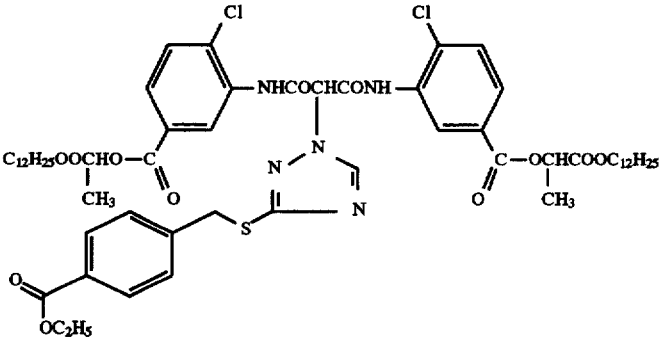

-continued

I-15

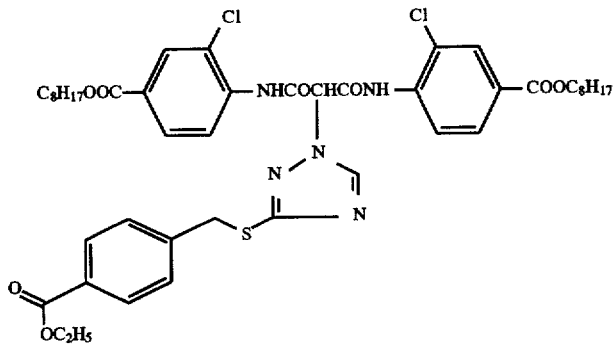

I-16

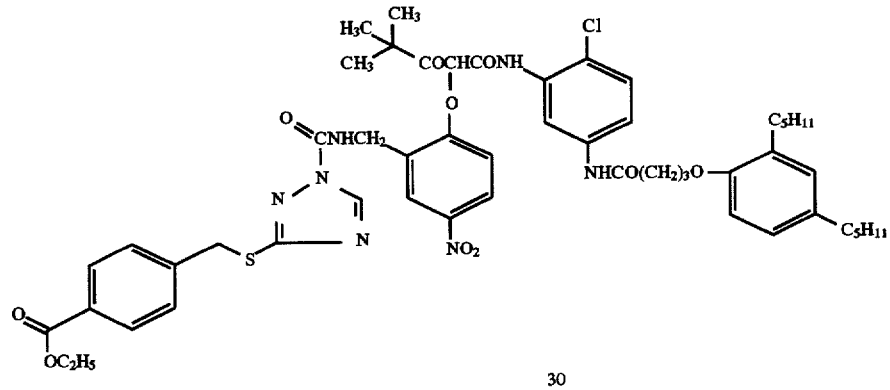

The yellow dye-forming DIR couplers for use in this invention can be prepared according to conventional procedures for preparing DIR couplers. Generally, this involves first attaching the TIME group, if this is present, to the appropriate coupler moiety, followed by the appropriate 1,2,4-triazole compound to form the desired DIR coupler. Alternatively, the TIME group can be attached to the coupler moiety after first combining the TIME and the 1,2,4-triazole compound by an appropriate reaction. In absence of a TIME group, the 1,2,4-triazole compound is attached to the coupler moiety directly. For example, the couplers of formula (I) can be readily obtained by condensing known yellow couplers having a halogen atom attached to the coupling position with the 1,2,4-triazole development inhibitor compounds above described. This reaction is advantageously carried out in an organic solvent, such as dimethylformamide, acetone or acetonitrile, in the presence of a base, such as sodium carbonate, triethylamine or alkali. Attachment of the 1,2,4-triazole compound to the carbon atom of the coupling position is possible through various nitrogen atoms of the 1,2,4-triazole compound, so that various isomers can be obtained for the yellow dye-forming DIR coupler. Since this isomerism does not affect the performances of the DIR couplers according to this invention, a detailed discussion of the structure of possible isomers is not needed. Illustrative examples of syntheses are shown below.

SYNTHESIS EXAMPLE 1

Synthesis of INH-1

50 g of 5-mercapto, 1,2,4-triazole and 32 g of KOH were solubilized in 500 ml of $CH_3OH$ and a solution of 107.5 g of 4-bromomethyl-benzoic acid in 400 ml of $CH_3OH$ was added under stirring. The solution was refluxed for 2 hours. After standing overnight at room temperature, a white solid was collected by filtration and stirred at room temperature for 4 hours in a solution of 1000 ml of $H_2O$ at pH 1 with HCl. The product was collected and dried. The yield was 80% by weight (Intermediate 1).

20 g of Intermediate 1 were suspended in 200 ml $C_2H_5OH$ and 20 ml concentrated $H_2SO_4$. After refluxing for 4 hours, the solvent was evaporated and 200 ml of $H_2O$ were added. A white solid was collected by filtration, washed with water and recrystallized from acetonitrile. The yield was 85% by weight of INH-1, whose structure was confirmed by elemental analysis and NMR spectrum.

SYNTHESIS EXAMPLE 2

Synthesis of yellow dye-forming coupler I-1

117.38 g of INH-1 and 270 g of the chloro derivative of the yellow coupler N-4(-((4-(2,4-(1,1-dimethylpropyl) phenoxy)1-oxobutylamino)-2-chlorophenyl)-4,4-dimethyl-3-oxopentanamide were solubilized in 500 ml of dimethylformamide. 102 g of $Na_2CO_3$ were added and, after stirring for 24 hours at room temperature, the suspension was poured in $H_2O$ at pH 1 with HCl. The white solid was collected by filtration and dried. The resulting crude product was recrystallized from $C_2H_5OH$ to obtain 200 g of coupler I-1 whose structure was confirmed by elemental analysis and NMR spectrum.

In a multilayer silver halide color photographic element, the yellow dye-forming couplers according to the present invention are preferably used in a blue-sensitive silver halide emulsion layer containing a yellow dye-forming coupler.

The yellow dye-forming couplers to be used in the present invention include the oil protection type acylacetamide couplers. Specific examples thereof are described in U.S. Pat. Nos. 2,407,210, 2,875,057, 3,265,506, etc. In the present invention, the use of two-equivalent couplers is preferable, and typical examples thereof include yellow couplers wherein the splitting-off group is attached through an oxygen atom, such as those described in U.S. Pat. Nos. 3,408,194, 3,447,928, 3,933,501 and 4,022,620 and yellow couplers wherein the splitting-off group is attached through a nitrogen atom, such as those described in U.S. Pat. Nos. 4,401,752 and 4,326,024, RD 18053 (April 1979), GB 1,425,020, and in DE 2,219,917, 2,261,361, 2,329,587 and 2,433,812. Among these couplers, alpha-pivaloylacetanilide type couplers are excellent in fastness of color dyes, whereas alpha-benzoylacetanilide type couplers provide high color density.

Yellow dye-forming couplers particularly preferable in the present invention are alkoxybenzoylacetanilide couplers represented by the general formula (IV):

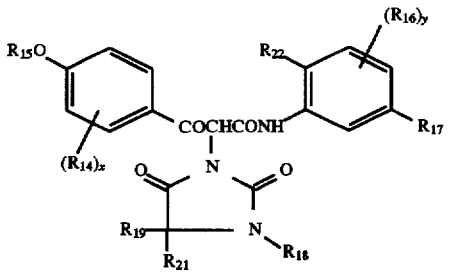

(IV)

wherein $R_{14}$ and $R_{16}$, equal or different, each represents an alkyl group having 1 to 4 carbon atoms (such as methyl, ethyl, propyl, butyl, chloromethyl, trifluoromethyl, etc.), aryl group preferable having 6 to 12 carbon atoms (such as phenyl, benzyl, tolyl, etc.), halogen atom (such as chlorine, bromine, etc.) or alkoxy group preferably having 1 to 15 carbon atoms (such as methoxy, isopropoxy, octyloxy, etc.); x and y are individually 0, 1 or 2; $R_{15}$ is an alkyl group having 1 to 4 carbon atoms (such as methyl, ethyl, propyl, butyl, chloromethyl, trifluoromethyl, etc.); $R_{17}$ is a ballast group as defined in formula (II); $R_{18}$ represents a hydrogen atom, an alkyl group (such as methyl, ethyl, propyl, isopropyl, amyl, isoamyl, hexyl, carboxymethyl, hexadecyl, etc.), an aryl group (such as phenyl, naphthyl, etc.) or an acyl group (such as acetyl, propionyl, octanoyl, benzoyl, etc.); $R_{19}$ is a hydrogen atom, an alkyl group (such as methyl, ethyl, propyl, isopropyl, amyl, isoamyl, hexyl, carboxymethyl, hexadecyl, etc.), —O—$R_{20}$ or —S—$R_{20}$ wherein $R_{20}$ is a hydrogen atom, an alkyl group (such as methyl, ethyl, propyl, isopropyl, amyl, isoamyl, hexyl, carboxymethyl, hexadecyl, etc.), an aryl group (such as phenyl, naphthyl, etc.), a heterocyclic group bonded to the oxygen or sulfur atom through one carbon forming said heterocyclic group (such as 2-tetrahydropyranyl, 2-pyridyl, 4-pyridyl, etc.), or an acyl group (such as acetyl, propionyl, octanoyl, benzoyl, etc.); $R_{22}$ is a hydrogen atom, an alkyl group (such as methyl, ethyl, propyl, isopropyl, amyl, isoamyl, hexyl, carboxymethyl, hexadecyl, etc.), or an aryl group (such as phenyl, naphthyl, etc.); $R_{22}$ is a halogen atom (such as chlorine, bromine, etc.) or an alkoxy group having 1 to 15 carbon atoms (such as methoxy, chloromethoxy, ethoxy, butoxy, etc.).

In particular, in the present invention, said alkoxybenzoylacetanilide yellow dye-forming couplers are represented by the general formula (V):

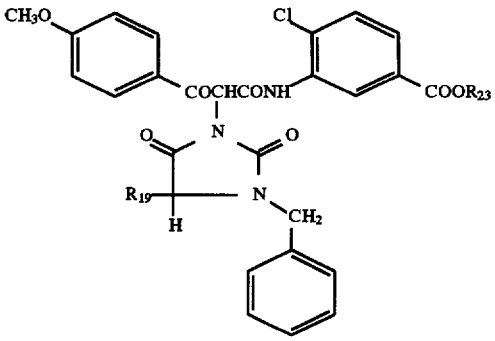

(V)

wherein $R_{19}$ is the same as in formula (IV) and $R_{23}$ is an alkyl group having 8 to 32 carbon atoms.

Specific examples of alkoxybenzoylacetanilide yellow dye-forming couplers for use in the present invention are given below as illustrative examples.

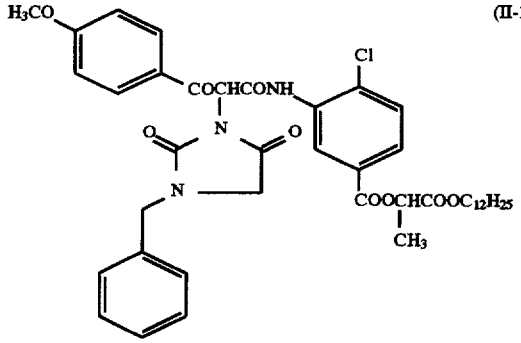

(II-1)

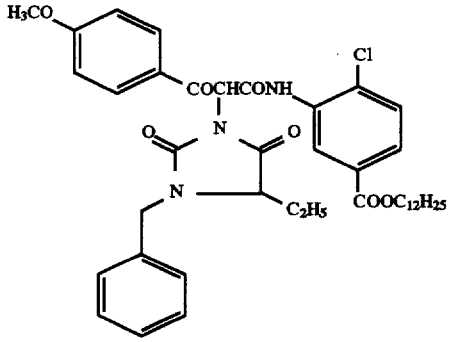

(II-2)

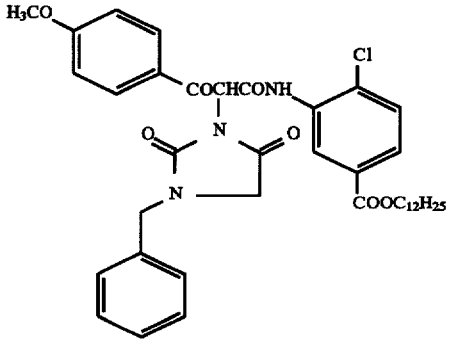

(II-3)

-continued (II-4)

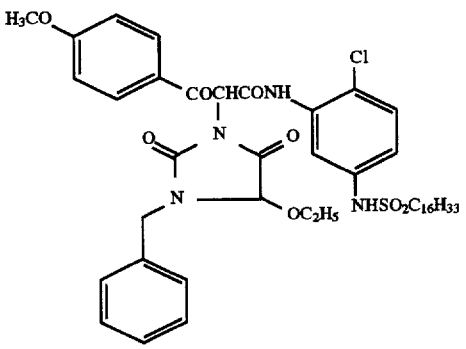

(II-5)

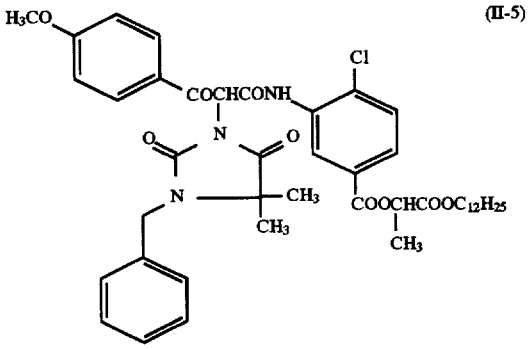

(II-6)

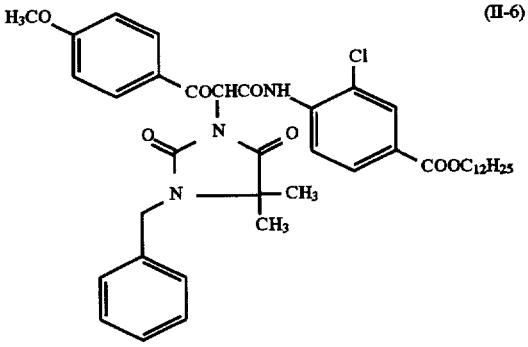

(II-7)

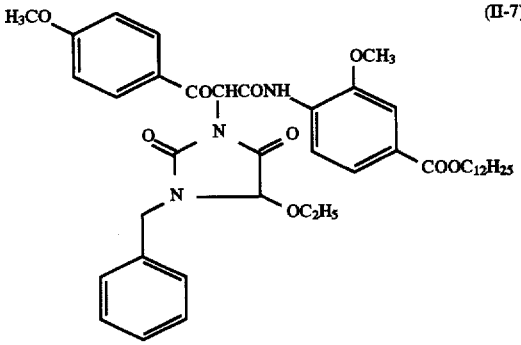

-continued (II-8)

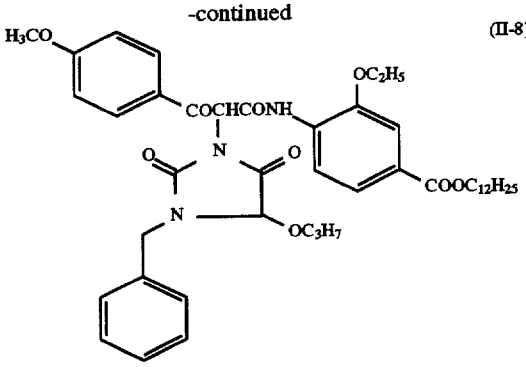

(II-9)

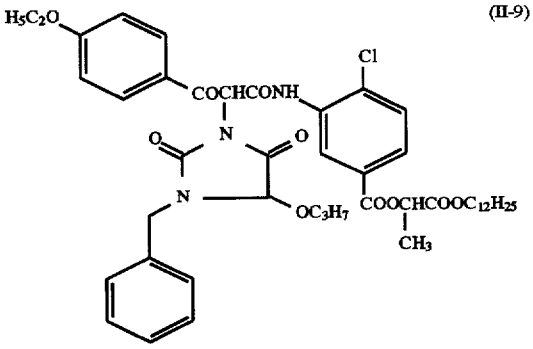

(II-9)

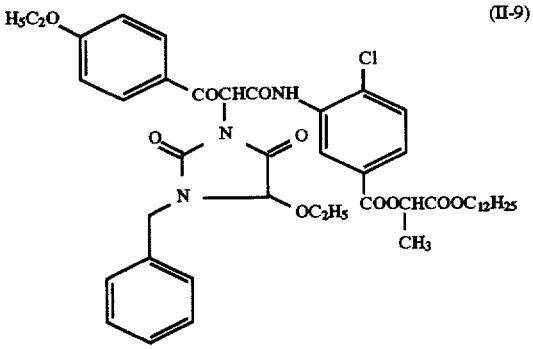

In the present invention, the blue-sensitive layer is composed of two or more silver halide emulsion layers sensitized to the same spectral region of the visible spectrum, the uppermost silver halide emulsion layer of which having the highest sensitivity and the lowermost silver halide emulsion layer having the lowest sensitivity, as described in GB 923,045, U.S. Pat. No. 3,843,369 and U.S. Pat. No. 4,582,780. The two or more silver halide emulsions are arranged so that light travels through the uppermost highest sensitivity blue-sensitive layer before striking the lowermost lowest sensitivity blue-sensitive layer. The difference in sensitivity between the highest and the lowest blue-sensitive layers, as referred to herein, is preferably such that extended latitude in the photographic element is achieved without an appreciable distortion of the shape of the sensitometric curve. Generally, this difference in sensitivity should be within the range of from about 0.2 to about 1 logE (E being exposure) and preferably will be about 0.5 IogE. Also, the uppermost highest sensitivity blue-sensitive emulsion layer produces upon development a colored image of lower color density than the lowermost lowest sensitivity blue-sensitive emulsion layer. Generally, the uppermost highest sensitivity blue-sensitive emulsion layer is relatively "starved" with respect to its color coupler content in order to improve granularity of this layer (as disclosed by GB 923,045). That is, relatively smaller amounts of coupler are used in the highest sensitivity layer, such that, upon exposure and development, this layer produces a colored image which is less dense than that produced in the lowest sensitivity layer.

Preferably, in the present invention, both the uppermost highest sensitivity blue-sensitive silver halide emulsion layer and the lowermost lowest sensitivity blue-sensitive silver halide emulsion layer comprise the yellow dye-forming coupler and the yellow dye-forming DIR coupler as described above. In the uppermost layer, the yellow dye-forming coupler is used in an amount ranging from 0.01 to 0.5 mol per mol of silver halide, preferably 0.02 to 0.1 mol, and the DIR coupler is used in an amount of 0.001 to 0.1 mol per mol of silver halide, preferably 0.002 to 0.01 mol. In the lowermost layer, the yellow dye-forming coupler is used in an amount ranging from 0.04 to 2 mol per mol of silver halide, preferably 0.08 to 0.4 mol, and the DIR coupler is used in an amount of 0.002 to 0.2 mol per mol of silver halide, preferably 0.004 to 0.02 mol.

The color photographic elements of the present invention can be conventional photographic elements containing a silver halide as a light-sensitive substance.

The silver halides used in the multilayer color photographic elements of this invention may be a fine dispersion (emulsion) of silver chloride, silver bromide, silver chlorobromide, silver iodo-bromide and silver chloro-iodobromide grains in a hydrophilic binder. Preferred silver halides are silver iodo-bromide or silver iodo-bromo-chloride containing 1 to 20% mole silver iodide. In silver iodo-bromide emulsions or silver iodo-bromo-chloride, the iodide can be uniformly distributed among the emulsion grains, or iodide level can varied among the grains. The silver halides can have a uniform grain size or a broad grain size distribution. The silver halide grains may be regular grains having a regular crystal structure such as cubic, octahedral, and tetradecahedral, or the spherical or irregular crystal structure, or those having crystal defects such as twin plane, or those having a tabular form, or the combination thereof.

The term "cubic grains" according to the present invention is intended to include substantially cubic grains, that is grains which are regular cubic grains bounded by crystallographic faces (100), or which may have rounded edges and/or vertices or small faces (111), or may even be nearly spherical when prepared in the presence of soluble iodides or strong ripening agents, such as ammonia. Particularly good results are obtained with silver halide grains having average grain sizes in the range from 0.2 to 3 μm, more preferably from 0.4 to 1.5 μm. Preparation of silver halide emulsions comprising cubic silver iodobromide grains is described, for example, in Research Disclosure, Vol. 184, Item 18431, Vol. 176, Item 17644 and Vol. 308, Item 308119.

Other silver halide emulsions for use in this invention are those which employ one or more light-sensitive tabular grain emulsions. The tabular silver halide grains contained in the emulsion of this invention have an average diameter:thickness ratio (often referred to in the art as aspect ratio) of at least 2:1, preferably 2:1 to 20:1, more preferably 3:1 to 14:1, and most preferably 3:1 to 8:1. Average diameters of the tabular silver halide grains suitable for use in this invention range from about 0.3 μm to about 5 μm, preferably 0.5 μm to 3 μm, more preferably 0.8 μm to 1.5 μm. The tabular silver halide grains suitable for use in this invention have a thickness of less than 0.4 μm, preferably less than 0.3 μm and more preferably less than 0.2 μm.

The tabular grain characteristics described above can be readily ascertained by procedures well known to those skilled in the art. The term "diameter" is defined as the diameter of a circle having an area equal to the projected area of the grain. The term "thickness" means the distance between two substantially parallel main planes constituting the tabular silver halide grains. From the measure of diameter and thickness of each grain the diameter:thickness ratio of each grain can be calculated, and the diameter:thickness ratios of all tabular grains can be averaged to obtain their average diameter:thickness ratio. By this definition, the average diameter:thickness ratio is the average of individual tabular grain diameter:thickness ratios. In practice, it is simpler to obtain an average diameter and an average thickness of the tabular grains and to calculate the average diameter:thickness ratio as the ratio of these two averages. Whatever the used method may be, the average diameter:thickness ratios obtained do not greatly differ.

In the silver halide emulsion layer containing tabular silver halide grains, at least 15%, preferably at least 25%, and, more preferably, at least 50% of the silver halide grains are tabular grains having an average diameter:thickness ratio of not less than 2:1. Each of the above proportions, "15%", "25%" and "50%" means the proportion of the total projected area of the tabular grains having a diameter:thickness ratio of at least 2:1 and a thickness lower than 0.4 μm, as compared to the projected area of all of the silver halide grains in the layer.

It is known that photosensitive silver halide emulsions can be formed by precipitating silver halide grains in an aqueous dispersing medium comprising a binder, gelatin preferably being used as a binder.

The silver halide grains may be precipitated by a variety of conventional techniques. The silver halide emulsion can be prepared using a single-jet method, a double-jet method, or a combination of these methods or can be matured using, for instance, an ammonia method, a neutralization method, an acid method, or can be performed an accelerated or constant flow rate precipitation, interrupted precipitation, ultrafiltration during precipitation, etc. References can be found in Trivelli and Smith, The Photographic Journal, Vol. LXXIX, May 1939, pp. 330–338, T. H. James, The Theory of The Photographic Process, 4th Edition, Chapter 3, U.S. Pat. Nos. 2,222,264, 3,650,757, 3,917,485, 3,790,387, 3,716,276, 3,979,213, Research Disclosure, Dec. 1989, Item 308119 "Photographic Silver Halide Emulsions, Preparations, Addenda, Processing and Systems", and Research Disclosure, Sept. 1976, Item 14987.

One common technique is a batch process commonly referred to as the double-jet precipitation process by which a silver salt solution in water and a halide salt solution in water are concurrently added into a reaction vessel containing the dispersing medium.

In the double jet method, in which alkaline halide solution and silver nitrate solution are concurrently added in the gelatin solution, the shape and size of the formed silver halide grains can be controlled by the kind and concentration of the solvent existing in the gelatin solution and by the addition speed. Double-jet precipitation processes are described, for example, in GB 1,027,146, GB 1,302,405, U.S. Pat. No. 3,801,326, U.S. Pat. No. 4,046,376, U.S. Pat.

No. 3,790,386, U.S. Pat. No. 3,897,935, 4,147,551, and U.S. Pat. No. 4,171,224.

The single jet method in which a silver nitrate solution is added in a halide and gelatin solution has been long used for manufacturing photographic emulsion. In this method, because the varying concentration of halides in the solution determines which silver halide grains are formed, the formed silver halide grains are a mixture of different kinds of shapes and sizes.

Precipitation of silver halide grains usually occurs in two distinct stages. In a first stage, nucleation, formation of fine silver halide grain occurs. This is followed by a second stage, the growth stage, in which additional silver halide formed as a reaction product precipitates onto the initially formed silver halide grains, resulting in a growth of these silver halide grains. Batch double-jet precipitation processes are typically undertaken under conditions of rapid stirring of reactants in which the volume within the reaction vessel continuously increases during silver halide precipitation and soluble salts are formed in addition to the silver halide grains.

In order to avoid soluble salts in the emulsion layers of a photographic material from crystallizing out after coating and other photographic or mechanical disadvantages (stickiness, brittleness, etc.), the soluble salts formed during precipitation have to be removed.

In preparing the silver halide emulsions for use in the present invention, a wide variety of hydrophilic dispersing agents for the silver halides can be employed. As hydrophilic dispersing agent, any hydrophilic polymer conventionally used in photography can be advantageously employed including gelatin, a gelatin derivative such as acylated gelatin, graft gelatin, etc., albumin, gum arabic, agar agar, a cellulose derivative, such as hydroxyethylcellulose, carboxymethylcellulose, etc., a synthetic resin, such as polyvinyl alcohol, polyvinylpyrrolidone, polyacrylamide, etc. Other hydrophilic materials useful known in the art are described, for example, in Research Disclosure, Vol. 308, Item 308119, Section IX.

The silver halide grain emulsion for use in the present invention can be chemically sensitized using sensitizing agents known in the art. Sulfur containing compounds, gold and noble metal compounds, and polyoxylakylene compounds are particularly suitable. In particular, the silver halide emulsions may be chemically sensitized with a sulfur sensitizer, such as sodium thiosulfate, allylthiocyanate, allylthiourea, thiosulfinic acid and its sodium salt, sulfonic acid and its sodium salt, allylthiocarbamide, thiourea, cystine, etc.; an active or inert selenium sensitizer; a reducing sensitizer such as stannous salt, a polyamine, etc.; a noble metal sensitizer, such as gold sensitizer, more specifically potassium aurithiocyanate, potassium chloroaurate, etc.; or a sensitizer of a water soluble salt such as for instance of ruthenium, rhodium, iridium and the like, more specifically, ammonium chloropalladate, potassium chloroplatinate and sodium chloropalladite, etc.; each being employed either alone or in a suitable combination. Other useful examples of chemical sensitizers are described, for example, in Research Disclosure 17643, Section III, 1978 and in Research Disclosure 308119, Section III, 1989.

The silver halide emulsion for use in the present invention can be spectrally sensitized with dyes from a variety of classes, including the polymethyne dye class, which includes the cyanines, merocyanines, complex cyanines and merocyanines, oxonols, hemioxonols, styryls, merostyryls, and streptocyanine.

The cyanine spectral sensitizing dyes include, joined by a methine linkage, two basic heterocyclic nuclei, such as those derived from quinoline, pyrimidine, isoquinoline, indole, benzindole, oxazole, thiazole, selenazole, imidazole, benzoxazole, benzothiazole, benzoselenazole, benzoimidazole, naphthoxazole, naphthothiazole, naphthoselenazole, tellurazole, oxatellurazole.

The merocyanine spectral sensitizing dyes include, joined by a methine linkage, a basic heterocyclic nucleus of the cyanine-dye type and an acidic nucleus, which can be derived from barbituric acid, 2-thiobarbituric acid, rhodanine, hydantoin, 2-thiohydantoin, 2-pyrazolin-5-one, 2-isoxazolin-5-one, indan-1,3-dione, cyclohexane-1,3-dione, 1,3-dioxane-4,6-dione, pyrazolin-3,5-dione, pentane-2,4-dione, alkylsulfonylacetonitrile, malononitrile, isoquinolin-4-one, chromane-2,4-dione, and the like.

One or more spectral sensitizing dyes may be used. Dyes with sensitizing maxima at wavelengths throughout the visible and infrared spectrum and with a great variety of spectral sensitivity curve shapes are known. The choice and relative proportion of dyes depends on the region of the spectrum to which sensitivity is desired and on the shape of the spectral sensitivity desired.

Examples of sensitizing dyes can be found in Venkataraman, *The chemistry of Synthetic Dyes*, Academic Press, New York, 1971, Chapter V, James, *The Theory of the Photographic Process*, 4th Ed., Macmillan, 1977, Chapter 8, F. M. Hamer, *Cyanine Dyes and Related Compounds*, John Wiley and Sons, 1964, and in Research Disclosure 308119, Section III, 1989.

The silver halide emulsions for use in this invention can contain optical brighteners, antifogging agents and stabilizers, filtering and antihalo dyes, hardeners, coating aids, plasticizers and lubricants and other auxiliary substances, as for instance described in Research Disclosure 17643, Sections V, VI, VIII, X, XI and XII, 1978, and in Research Disclosure 308119, Sections V, VI, VIII, X, XI, and XII, 1989.

The silver halide emulsion for use in the present invention can be used for the manufacture of multilayer light-sensitive silver halide color photographic elements, such as color negative photographic elements, color reversal photographic elements, color positive photographic elements, false color address photographic elements (such as those disclosed in U.S. Pat. No. 4,619,892) and the like, the preferred ones being color negative photographic elements.

Silver halide multilayer color photographic elements usually comprise, coated on a support, a red sensitized silver halide emulsion layer associated with cyan dye-forming color couplers, a green sensitized silver halide emulsion layer associated with magenta dye-forming color couplers and a blue sensitized silver halide emulsion layer associated with yellow dye-forming color couplers. Each layer is usually comprised of multiple (two or more) emulsion sub-layers sensitive to a given region of visible spectrum. When multilayer materials contain multiple blue, green or red sub-layers, these can be in any case relatively faster and relatively slower sub-layers. These elements additionally comprise other non-light sensitive layers, such as intermediate layers, filter layers, antihalation layers and protective layers, thus forming a multilayer structure. These color photographic elements, after imagewise exposure to actinic radiation, are processed in a chromogenic developer to yield a visible color image. The layer units can be coated in any conventional order, but in a preferred layer arrangement the red-sensitive layers are coated nearest the support and are overcoated by the green-sensitive layers, a yellow filter layer and the blue-sensitive layers.

Suitable color couplers are preferably selected from the couplers having diffusion preventing groups, such as groups having a hydrophobic organic residue of about 8 to 32 carbon atoms, introduced into the coupler molecule in a non-splitting-off position. Such a residue is called a "ballast group". The ballast group is bonded to the coupler nucleus directly or through an imino, ether, carbonamido, sulfonamido, ureido, ester, imide, carbamoyl, sulfamoyl bond, etc. Examples of suitable ballasting groups are described in U.S. Pat. No. 3,892,572.

Said non-diffusible couplers are introduced into the light-sensitive silver halide emulsion layers or into non-light-sensitive layers adjacent thereto. On exposure and color development, said couplers give a color which is complementary to the light color to which the silver halide emulsion layers are sensitive. Consequently, at least one non-diffusible cyan-image forming color coupler, generally a phenol or an α-naphthol compound, is associated with red-sensitive silver halide emulsion layers, at least one non-diffusible magenta image-forming color coupler, generally a 5-pyrazolone or a pyrazolotriazole compound, is associated with green-sensitive silver halide emulsion layers and at least one non-diffusible yellow image forming color coupler, generally an acylacetanilide compound, is associated with blue-sensitive silver halide emulsion layers.

Said color couplers may be 4-equivalent and/or 2-equivalent couplers, the latter requiring a smaller amount of silver halide for color production. As it is well known, 2-equivalent couplers derive from 4-equivalent couplers since, in the coupling position, they contain a substituent which is released during coupling reaction. 2-equivalent couplers which may be used in silver halide color photographic elements include both those substantially colorless and those which are colored ("masking couplers"). The 2-equivalent couplers also include white couplers which do not form any dye on reaction with the color developer oxidation products. The 2-equivalent color couplers include also DIR couplers which are capable of releasing a diffusing development inhibiting compound on reaction with the color developer oxidation products.

The most useful cyan-forming couplers are conventional phenol compounds and α-naphthol compounds. Examples of cyan couplers can be selected from those described in U.S. Pat. Nos. 2,369,929; 2,474,293; 3,591,383; 2,895,826; 3,458,315; 3,311,476; 3,419,390; 3,476,563 and 3,253,924; in British patent 1,201,110, and in Research Disclosure 308119, Section VII, 1989.

The most useful magenta-forming couplers are conventional pyrazolone type compounds, indazolone type compounds, cyanoacetyl compounds, pyrazolotriazole type compounds, etc, and particularly preferred couplers are pyrazolone type compounds. Magenta-forming couplers are described for example in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445, in DE patent 1,810,464, in DE patent applications 2,408,665, 2,417,945, 2,418,959 and 2,424,467; in JP patent applications 20,826/76, 58,922/77, 129,538/74, 74,027/74, 159,336/75, 42,121/77, 74,028/74, 60,233/75, 26,541/76 and 55,122/78, and in Research Disclosure 308119, Section VII, 1989.

The most useful yellow-forming couplers which can be used in combination with the yellow dye-forming couplers described hereinbefore are conventional open-chain ketomethylene type couplers. Particular examples of such couplers are benzoyl acetanilide type and pivaloyl acetanilide type compounds. Yellow-forming couplers that can be used are specifically described in U.S. Pat. Nos. 2,875,057, 3,235,924, 3,265,506, 3,278,658, 3,369,859, 3,408,194, 3,415,652 3,528,322, 3,551,151, 3,682,322, 3,725,072 and 3,891,445, in DE patents 2,219,917, 2,261,361 and 2,414,006, in GB patent 1,425,020, in JP patent 10,783/76 and in JP patent applications 26,133/72, 73,147/73, 102,636/76, 6,341/75, 123,342/75, 130,442/75, 1,827/76, 87,650/75, 82,424/77 and 115,219/77, and in Research Disclosure 308119, Section VII, 1989.

Colored couplers can be used which include those described for example in U.S. Pat. Nos. 3,476,560, 2,521,908 and 3,034,892, in JP patent publications 2,016/69, 22,335/63, 11,304/67 and 32,461/69, in JP patent applications 26,034/76 and 42,121/77 and in DE patent application 2,418,959. The light-sensitive silver halide color photographic element may contain high molecular weight color couplers as described for example in U.S. Pat. No. 4,080,211, in EP Pat. Appl. No. 27,284 and in DE Pat. Appl. Nos. 1,297,417, 2,407,569, 3,148,125, 3,217,200, 3,320,079, 3,324,932, 3,331,743, and 3,340,376, and in Research Disclosure 308119, Section VII, 1989.

Colored cyan couplers can be selected from those described in U.S. Pat. Nos. 3,934,802; 3,386,301 and 2,434,272, colored magenta couplers can be selected from the colored magenta couplers described in U.S. Pat. Nos. 2,434,272; 3,476,564 and 3,476,560 and in British patent 1,464,361. Colorless couplers can be selected from those described in British patents 861,138; 914,145 and 1,109,963 and in U.S. Pat. No. 3,580,722 and in Research Disclosure 308119, Section VII, 1989.

Also, couplers providing diffusible colored dyes can be used together with the above mentioned couplers for improving graininess and specific examples of these couplers are magenta couplers described in U.S. Pat. No. 4,366,237 and GB Pat. No. 2,125,570 and yellow, magenta and cyan couplers described in EP Pat. No. 96,873, in DE Pat. Appl. No. 3,324,533 and in Research Disclosure 308119, Section VII, 1989.

Also, among the 2-equivalent couplers are those couplers which carry in the coupling position a group which is released in the color development reaction to give a certain photographic activity, e.g. as development inhibitor or accelerator or bleaching accelerator, either directly or after removal of one or further groups from the group originally released. Examples of such 2-equivalent couplers include the known DIR couplers as well as DAR, FAR and BAR couplers. Typical examples of said couplers are described in DE Pat. Appl. Nos. 2,703,145, 2,855,697, 3,105,026, 3,319,428, 1,800,420, 2,015,867, 2,414,006, 2,842,063, 3,427,235, 3,209,110, and 1,547,640, in GB Pat. Nos. 953,454 and 1,591,641, in EP Pat. Appl. Nos. 89,843, 117,511, 118,087, 193,389, and 301,477 and in Research Disclosure 308119, Section VII, 1989.

Examples of non-color forming DIR coupling compounds which can be used in silver halide color elements include those described in U.S. Pat. Nos. 3,938,996; 3,632,345; 3,639,417; 3,297,445 and 3,928,041; in German patent applications S.N. 2,405,442; 2,523,705; 2,460,202; 2,529,350 and 2,448,063; in Japanese patent applications S.N. 143,538/75 and 147,716/75, in British patents 1,423,588 and 1,542,705 and 301,477 and in Research Disclosure 308119, Section VII, 1989.

In order to introduce the couplers into the silver halide emulsion layer, some conventional methods known to the skilled in the art can be employed. According to U.S. Pat. Nos. 2,322,027, 2,801,170, 2,801,171 and 2,991,177, the couplers can be incorporated into the silver halide emulsion layer by the dispersion technique, which consists of dissolving the coupler in a water-immiscible high-boiling organic solvent and then dispersing such a solution in a hydrophilic colloidal binder under the form of very small droplets. The preferred colloidal binder is gelatin, even if some other kinds of binders can be used.

Another type of introduction of the couplers into the silver halide emulsion layer consists of the so-called "loaded-latex technique". A detailed description of such technique can be found in BE patents 853,512 and 869,816, in U.S. Pat. Nos. 4,214,047 and 4,199,363 and in EP patent 14,921. It consists of mixing a solution of the couplers in a water-miscible organic solvent with a polymeric latex consisting of water as a continuous phase and of polymeric particles having a mean diameter ranging from 0.02 to 0.2 micrometers as a dispersed phase.

Another useful method is further the Fisher process. According to such a process, couplers having a water-soluble group, such as a carboxyl group, a hydroxy group, a sulfonic group or a sulfonamido group, can be added to the photographic layer for example by dissolving them in an alkaline water solution.

Useful methods of introduction of couplers into silver halide emulsions are described in Research Disclosure 308119, Section VII, 1989.

The layers of the photographic elements can be coated on a variety of supports, such as cellulose esters supports (e.g., cellulose triacetate supports), paper supports, polyesters film supports (e.g., polyethylene terephthalate film supports or polyethylene naphthalate film supports), and the like, as described in Research Disclosure 308119, Section XVII, 1989.

The photographic elements according to this invention, may be processed after exposure to form a visible image upon association of the silver halides with an alkaline aqueous medium in the presence of a developing agent contained in the medium or in the material, as known in the art. The aromatic primary amine color developing agent used in the photographic color developing composition can be any of known compounds of the class of p-phenylendiamine derivatives, widely employed in various color photographic process. Particularly useful color developing agents are the p-phenylendiamine derivatives, especially the N,N-dialkyl-p-phenylene diamine derivatives wherein the alkyl groups or the aromatic nucleus can be substituted or not substituted.

Examples of p-phenylene diamine developers include the salts of: N,N-diethyl-p-phenylendiamine, 2-amino-5-diethylamino-toluene, 4-amino-N-ethyl-N-(α-methanesulphonamidoethyl)-m-toluidine, 4-amino-3-methyl-N-ethyl-N-(α-hydroxy-ethyl)-aniline, 4-amino-3-(α-methylsulfonamidoethyl)-N,N-diethylaniline, 4-amino-N,N-diethyl-3-(N'-methyl-α-methylsulfonamido)-aniline, N-ethyl-N-methoxy-ethyl-3-methyl-p-phenylenediamine and the like, as described, for instance, in U.S. Pat. Nos. 2,552,241; 2,556,271; 3,656,950 and 3,658,525.

Examples of commonly used developing agents of the p-phenylene diamine salt type are: 2-amino-5-diethylaminotoluene hydrochloride (generally known as CD2 and used in the developing solutions for color positive photographic material), 4-amino-N-ethyl-N-(α-methanesulfonamidoethyl)-m-toluidine sesquisulfate monohydrate (generally known as CD3 and used in the developing solution for photographic papers and color reversal materials) and 4-amino-3-methyl-N-ethyl-N-(β-hydroxyethyl)-aniline sulfate (generally known as CD4 and used in the developing solutions for color negative photographic materials).

Said color developing agents are generally used in a quantity from about 0.001 to about 0.1 moles per liter, preferably from about 0.0045 to about 0.04 moles per liter of photographic color developing compositions.

In the case of color photographic materials, the processing comprises at least a color developing bath and, optionally, a prehardening bath, a neutralizing bath, a first (black and white) developing bath, etc. These baths are well known in the art and are described for instance in Research Disclosure 17643, 1978, and in Research Disclosure 308119, Sections XIX and XX, 1989.

After color development, the image-wise developed metallic silver and the remaining silver salts generally must be removed from the photographic element. This is performed in separate bleaching and fixing baths or in a single bath, called blix, which bleaches and fixes the image in a single step. The bleaching bath is a water solution having a pH equal to 5.60 and containing an oxidizing agent, normally a complex salt of an alkali metal or of ammonium and of trivalent iron with an organic acid, e.g., EDTA.Fe.$NH_4$, wherein EDTA is the ethylenediaminotetracetic acid, or PDTA.Fe.$NH_4$, wherein PDTA is the propylenediaminotetraacetic acid. While processing, this bath is continuously aired to oxidize the divalent iron which forms while bleaching the silver image and regenerated, as known in the art, to maintain the bleach effectiveness. The bad working of these operations may cause the drawback of the loss of cyan density of the dyes.

Further to the above mentioned oxidizing agents, the blix bath can contain known fixing agents, such as for example ammonium or alkali metal thiosulfates. Both bleaching and fixing baths can contain other additives, e.g., polyalkyleneoxide compounds, as described for example in GB patent 933,008 in order to increase the effectiveness of the bath, or thioether compounds known as bleach accelerators.

The present invention will be illustrated with reference to the following examples, but it should be understood that these examples do not limit the present invention.

EXAMPLE 1

This example illustrates that compounds released from the yellow dye-forming DIR couplers for use in this invention are good development inhibitors compared to known triazole compounds. For this evaluation, the development inhibitor compounds were added to a blue-sensitive silver bromoiodide gelatin emulsion containing a gelatin hardener. The emulsion was then coated on a support and dried. Samples of the single-layer photographic coatings were exposed to a light source having a color temperature of 5,500 K (white light exposure). The exposed samples were then color processed using the KODAK FLEXICOLOR (C41) process as described in *British Journal of Photography Annual*, 1988, pp. 196–198, in the following sequence:

1. Color development
2. Bleach
3. Wash
4. Fix
5. Wash

For each processed sample, the characteristic curve for the blue light absorption was obtained conventionally. The following Table 1 reports the differences in sensitivity to blue light in Log E at density of 0.2 above Dmin (Speed Loss) for two added amounts of each development inhibitor compared with a reference sample with no development inhibitor.

TABLE 1

| Dev. Inhibitor | Speed Loss 117 mg/mAg | Speed Loss 469 mg/mAg |
|---|---|---|
| None | ref. | ref. |
| A (comp.) | −0.09 | −0.28 |
| B (comp.) | 0.00 | 0.00 |
| C (comp.) | 0.00 | 0.00 |
| INH-1 (inv.) | −0.08 | −0.20 |
| INH-3 (inv.) | −0.07 | −0.11 |
| INH-5 (inv.) | −0.06 | −0.10 |
| D (comp.) | 0.00 | 0.00 |

The comparison compound A is described as compound no. 102 in U.S. Pat. No. 4,359,521 and has the structure

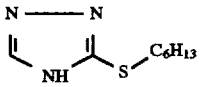

The comparison compounds B and C are described as development inhibitors in U.S. Pat. No. 5,021,331 and have, respectively, the structures

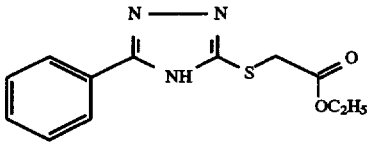

-continued and

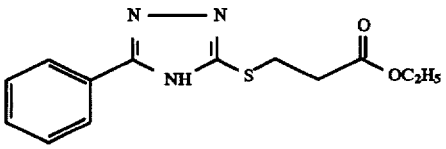

The comparison compound D is the hydrolyzed form of INH-1 and has the formula

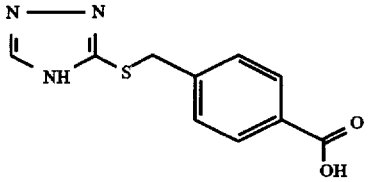

The comparison compound A shows good development inhibitor property but does not contain a hydrolyzable group and therefore is not inactivated when accumulated in the processing solution. The comparison compounds B and C (i.e., 1,2,4-triazole compounds having hydrolyzable groups) do not have development inhibiting properties. The compounds according to the present invention have good development inhibiting properties, and are rendered inactive as development inhibitor by hydrolysis (compound D).

EXAMPLE 2

To demonstrate the advantage of speed, two photographic elements were prepared in which the following layers were coated on a cellulose triacetate support base with the following layers in the following order:

a) a first green-sensitive silver bromoiodide emulsion layer comprising the magenta dye-forming coupler M1 dispersed in tricresylphosphate, b) a second blue-sensitive silver bromoiodide emulsion layer coated at 1.62 mg/m$^2$ of silver and comprising the yellow dye-forming coupler Y1 at a coverage of 0.12 mol/mol Ag and a yellow dye-forming DIR coupler, as shown in Table 2, at a coverage of 4 mmol/mol Ag dispersed in dibutylphthalate and diethyllauramide, and c) an overcoat gelatin layer containing a gelatin hardener.

Magenta dye-forming coupler M1

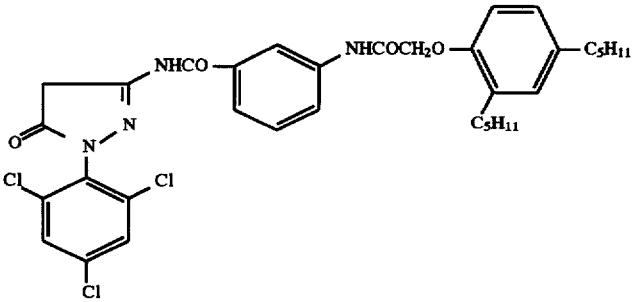

Yellow dye-forming coupler Y1

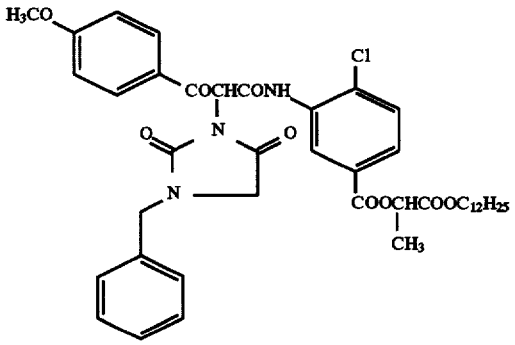

Yellow dye-forming DIR coupler YDIR1 (coupler no. 202 of U.S. Pat. No. 4,359,521)

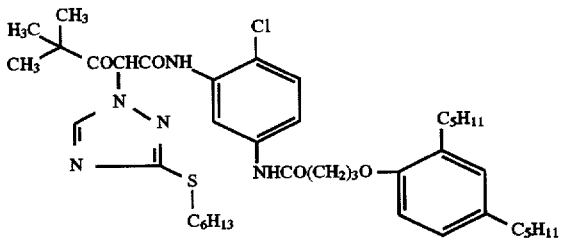

Samples of the elements were exposed and processed as described in Example 1. For each processed sample, the characteristic curves for the blue and the green light absorptions were obtained conventionally. The following Table 2 reports values of sensitivity in Log E at density of 0.2 above Dmin (Speed1) and 1.0 above Dmin (Speed2) and toe contrast (Gamma) for the blue and the green sensitive layer, and values of interimage effects for the green sensitive layer. The interimage effects were calculated as follows. Samples of each film were exposed to a light source having a color temperature of 5,500 K through a Kodak Wratten™ W99 filter and an optical step wedge (selective exposure). Other samples of each film were exposed as above but without any filter (white light exposure). All the exposed samples were developed as described above. Contrasts of the obtained sensitometric curves for selective exposures (gammas) and white light exposures ($gamma_w$) were measured in the low dye-density or toe region. Interimage effects (IIE) are calculated as follows:

$$IIE = \frac{gamma_s - gamma_w}{gamma_w} \times 100$$

TABLE 2

| | Y DIR | Blue Sens. Layer | | | Green Sens. Layer | | | |
|---|---|---|---|---|---|---|---|---|
| Film | Coupler | Speed1 | Speed2 | Gamma | Speed1 | Speed2 | Gamma | IIE |
| 1 | Y DIR1 | 2.46 | 1.76 | 1.03 | 2.29 | 1.29 | 0.77 | 31 |
| 2 | I-1 | 2.52 | 1.86 | 1.12 | 2.35 | 1.47 | 0.88 | 31 |

In the table, film 1 containing the yellow dye-forming DIR coupler I-1 according to this invention provides a significant improvement of speed in the yellow and magenta layers, still maintaining good interimage effects. Increased advantages in speed can be obtained in seasoned developer solutions, since the development inhibitor released from YDIR1 does not contain hydrolyzable groups.

EXAMPLE 3

A multilayer silver halide color photographic film A1 was prepared by coating a cellulose triacetate support base, subbed with gelatin, with the following layers in the following order:

(1) a layer of black colloidal silver dispersed in gelatin having a silver coverage of 0.26 g/m$^2$ and a gelatin coverage of 1.33 g/m$^2$;

(2) a layer of low sensitivity red-sensitive silver halide emulsion comprising a sulfur and gold sensitized low-sensitivity silver bromoiodide emulsion (having 2.5% silver iodide moles and a mean grain size of 0.18 μm), optimally spectrally sensitized with sensitizing dyes S-1, S-2 and S-3, at a total silver coverage of 0.72 g/m$^2$ and a gelatin coverage of 0.97 g/m$^2$, containing the cyan dye-forming coupler C-1 at a coverage of 0.357 g/m$^2$, the cyan dye-forming DIR coupler C-2 at a coverage of 0.024 g/m$^2$ and the magenta colored cyan-dye forming masking coupler C3 at a coverage of 0.052 g/m$^2$, dispersed in a mixture of triphenylphosphate and butylacetanilide;

(3) a layer of medium-sensitivity red-sensitive silver halide emulsion comprising a sulfur and gold sensitized silver bromochloroiodide emulsion (having 7% silver iodide moles, 5% silver chloride moles and a mean grain size of 0.45 μm), optimally spectrally sensitized with sensitizing dyes S-1, S-2 and S-3, at a silver coverage of 0.84 g/m$^2$ and a gelatin coverage of 0.81 g/m$^2$, containing the cyan dye-forming coupler C-1 at a coverage of 0.324 g/m$^2$, the cyan dye-forming DIR coupler C-2 at a coverage of 0.024 g/m$^=$, and the magenta colored cyan dye-forming masking coupler C-3 at a coverage of 0.052 g/m$^2$, dispersed in a mixture of triphenylphosphate and butylacetanilide;

(4) a layer of high-sensitivity red-sensitive silver halide emulsion comprising a sulfur and gold sensitized silver bromoiodide emulsion (having 12% silver iodide moles and a mean grain size of 1.1 μm), optimally spectrally sensitized with sensitizing dyes S-1, S-2 and S-3, at a silver coverage of 1.53 g/m$^2$, and a gelatin coverage of 1.08 of 0.223 g/m$^2$, the cyan dye-forming DIR coupler C-2 at a coverage of 0.018 g/m$^2$ and the cyan dye-forming coupler C-4 at a coverage of 0.032 g/m$^2$, dispersed in a mixture of tricresylphosphate and butylacetanilide;

(5) an intermediate layer containing 1.13 g/m$^2$ of gelatin, 0.025 g/m$^2$ of UV absorber UV1, 0.025 g/m$^2$ of UV absorber UV2 and 0.071 g/m$^2$ of the hardener H-1;

(6) a layer of low sensitivity green sensitive silver halide emulsion comprising a sulfur and gold sensitized silver bromoiodide emulsion (having 2.5% silver iodide moles and a mean grain size of 0.18 μm), at a silver coverage of 0.65 g/m$^2$, optimally spectrally sensitized with sensitizing dyes S-4 and S-5, at a gelatin coverage of 1.2 g/m$^2$, containing the magenta dye-forming coupler M-1 at a coverage of 0.399 g/m$^2$, the magenta dye-forming DIR coupler M-2 at a coverage of 0.010 g/m$^2$, and the yellow colored magenta dye-forming couplers M-3 and M-4 at a coverage of 0.123 g/m$^2$, dispersed in tricresylphosphate;

(7) a layer of medium-sensitivity green sensitive silver halide emulsion comprising a sulfur and gold sensitized silver bromochloroiodide emulsion (having 7% silver iodide moles, 5% silver chloride moles and a mean grain size of 0.45 μm), optimally spectrally sensitized with sensitizing dyes S-4 and S-5, at a silver coverage of 0.74 g/m$^2$ and a gelatin coverage of 0.9 g/m$^2$, containing the magenta dye-forming coupler M-1 at a coverage of 0.222 g/m$^2$, the magenta dye-forming DIR coupler M-2 at a coverage of 0.004 g/m$^2$, and the yellow colored magenta dye forming couplers M-3 and M-4 at a coverage of 0.094 g/m$^2$, dispersed in tricresylphosphate;

(8) a layer of high-sensitivity red-sensitive silver halide emulsion comprising a sulfur and gold sensitized silver bromoiodide emulsion (having 12% silver iodide moles and a mean grain size of 1.1 μm), optimally spectrally sensitized with sensitizing dyes S-4 and S-5, at a silver coverage of 1.5 g/m$^2$ and a gelatin coverage of 1.2 g/m$^2$, containing the magenta dye-forming coupler M-1 at a coverage of 0.296 g/m$^2$, and the yellow colored magenta dye forming couplers M-3 and M-4 at a coverage of 0.043 g/m$^2$, dispersed in tricresylphosphate;

(9) an intermediate layer containing 1.06 g/m$^2$ of gelatin;

(10) a yellow filter layer containing 1.14 g/m$^2$ of gelatin and 0.045 g/m$^2$ of silver;

(11) a layer of low-sensitivity blue-sensitive silver halide emulsion comprising a blend of 63% by weight of the low-sensitivity emulsion of layer (2) and of 37% by weight of the medium-sensitivity emulsion of layer (3) at a total silver coverage of 0.53 g/m$^2$, optimally spectrally sensitized with sensitizing dye S-6, at a gelatin coverage of 1.65 g/m$^2$, containing the yellow dye forming coupler Y-1 at a coverage of 0.841 g/m$^2$ and the yellow dye forming DIR coupler Y-2 at a coverage of 0.038 g/m$^2$, dispersed in a mixture of diethyllauramide and dibutylphthalate; (12) a layer of high-sensitivity blue sensitive silver halide emulsion comprising a sulfur and gold sensitized silver bromoiodide emulsion (having 12% silver iodide moles and a mean grain size of 1.1 μm), optimally spectrally sensitized with sensitizing dye S-6, at a silver coverage of 0.92 g/m$^2$ and a gelatin coverage of 1.25 g/m$^2$, containing the yellow dye-forming coupler Y-1 at a coverage of 0.348 g/m$^2$ and the yellow dye forming DIR coupler Y-2 at a coverage of 0.005 g/m$^2$, dispersed in a mixture of diethyllauramide and dibutylphthalate;

(13) a protective layer of 1.29 g/m$^2$ of gelatin, comprising the UV absorber UV-1 at a coverage of 0.12 g/m$^2$, the UV absorber UV-2 at a coverage of 0.12 g/m$^2$, a fine grain silver bromide emulsion at a silver coverage of 0.15 g/m$^2$; and

(14) a top coat layer of 0.75 g/m$^2$ of gelatin containing 0.190 g/m$^2$ of polymethylmethacrylate matting agent MA-1 in form of beads having an average diameter of 2.5 micrometers, and the hardener H-2 at a coverage of 0.408 g/m$^2$.

Film B1 was prepared in a similar manner, but containing in the 11th blue-sensitive layer of film A10.835 g/m$^2$ and 0.044 g/m$^2$ of the yellow dye-forming DIR coupler I-1, and in the 12th blue-sensitive layer 0.318 g/m$^2$ of the yellow dye-forming Y-1 and 0.035 g/m$^2$ of the yellow dye-forming DIR coupler I-1.

Samples of films A1 and B1 were exposed and processed as described in Examples 1 and 2. For each processed sample, the characteristic curves for the blue, green and red light absorptions were obtained conventionally. The following Table 3 reports values of fog (Dmin), maximum optical density (Dmax), sensitivity in Log E at density of 0.2 above Dmin (Speed1) and toe contrast (Gamma) for the blue (Y), green (M) and red (Cy) sensitive layers, and values of interimage effects (IIE) for the green and the red sensitive layers.

TABLE 3

| Film | Y DIR C | Layer | Dmin | Dmax | Speed1 | Gamma | IIE |
|---|---|---|---|---|---|---|---|
| A1 | Y-2 | Y | 0.88 | 3.01 | 2.50 | 0.62 | |
| | | M | 0.66 | 2.67 | 2.40 | 0.59 | 27 |
| | | Cy | 0.30 | 2.27 | 2.27 | 0.57 | 21 |
| B1 | I-1 | Y | 0.93 | 2.98 | 2.55 | 0.56 | |
| | | M | 0.70 | 2.61 | 2.52 | 0.58 | 26 |
| | | Cy | 0.31 | 2.31 | 2.31 | 0.58 | 21 |

Improvement in speed is provided by film B1 comprising the yellow dye-forming DIR coupler I-1 according to this invention versus film A1 containing the yellow dye-forming DIR coupler Y-2.

Formulas of compounds used in this example are presented below.

Cyan dye forming coupler C-1

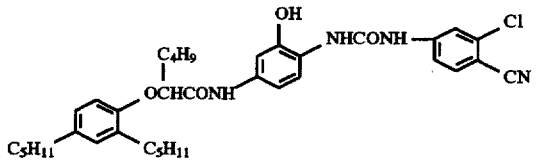

Cyan dye forming DIR coupler C-2

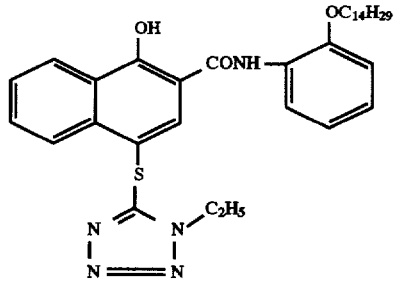

Magenta colored cyan dye forming coupler C-3

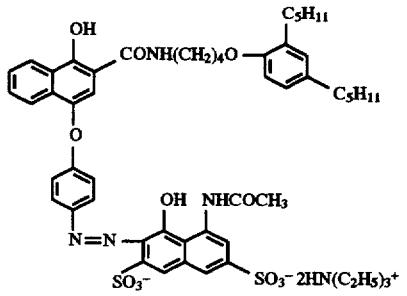

Cyan dye forming coupler C-4

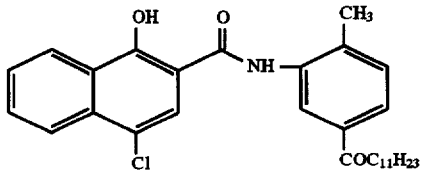

Magenta dye forming coupler M-1
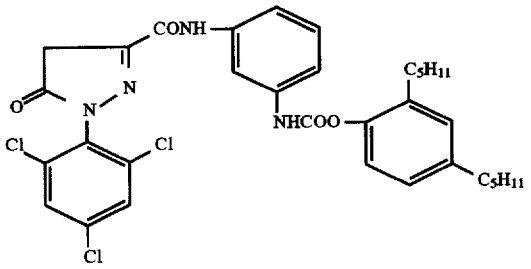
Magenta dye forming DIR coupler M-2
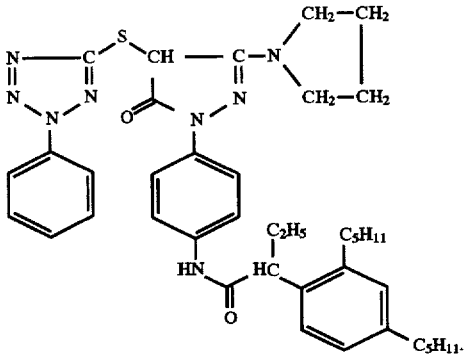
Yellow colored magenta dye forming coupler M-3
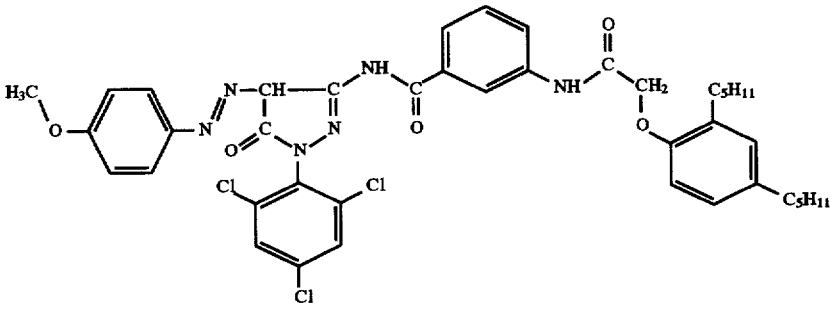
Yellow colored magenta dye forming coupler M-4
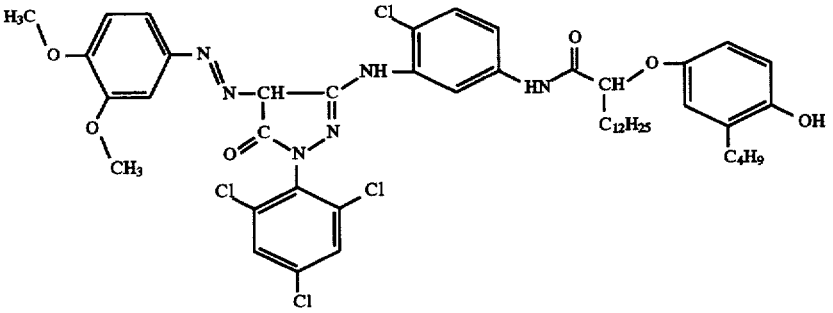
Yellow dye forming coupler Y-1
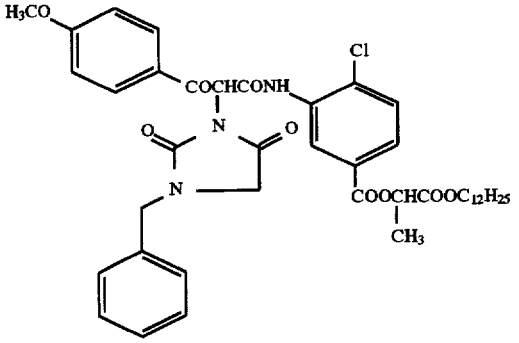

Yellow dye forming DIR coupler Y-2
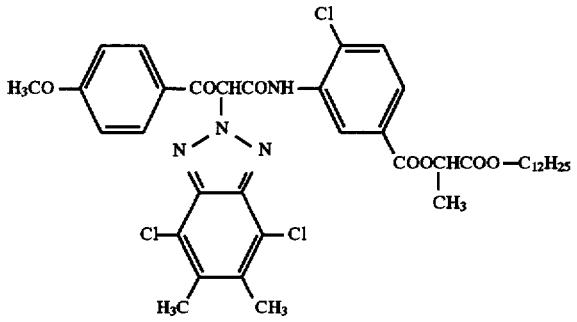
Yellow dye forming DIR coupler I-1
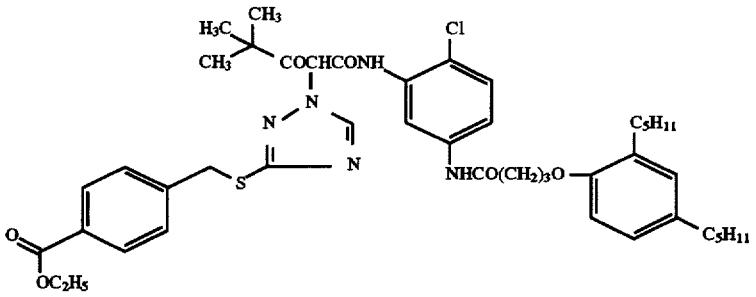
Red Sensitizer S-1
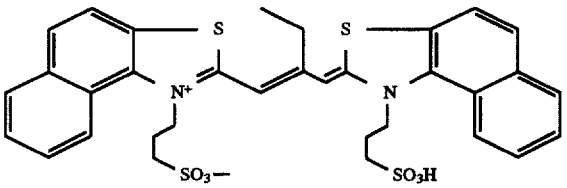
Red Sensitizer S-2
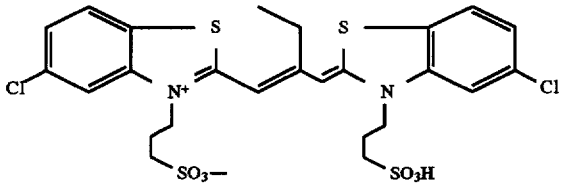
Red Sensitizer S-3
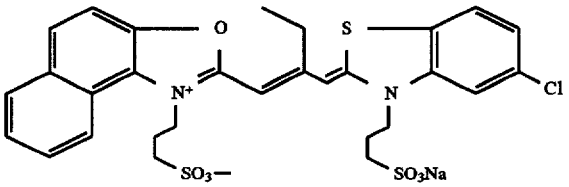
Green Sensitizer S-4
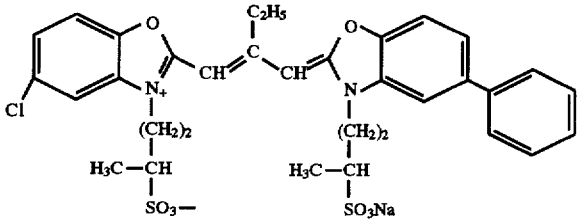
Green Sensitizer S-5
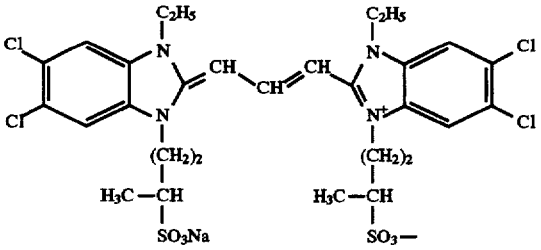
Blue Sensitizer S-6
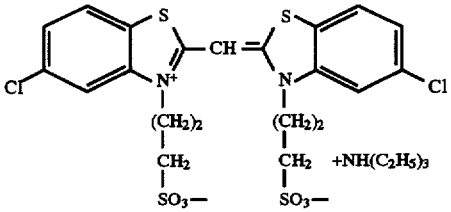

UV absorber UV-1

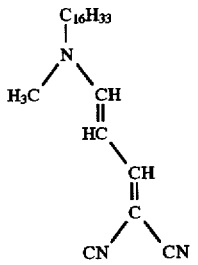

UV absorber UV-2

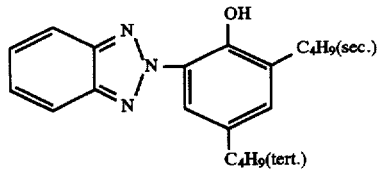

Matting agent MA-1

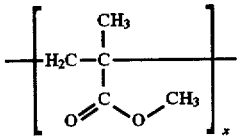

Hardener H-1

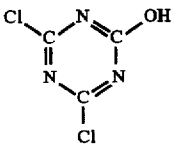

Hardener H-2

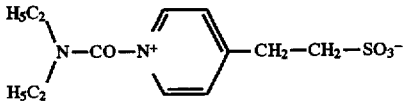

EXAMPLE 4

A multilayer color photographic film A2 was prepared similar to film A1 of Example 3, but containing in the 6th, 7th and 8th green-sensitive layers, to replace magenta dye-forming coupler M-1, magenta dye-forming coupler M-5 in amounts, respectively, of 0.259, 0.134 and 0.115 g/m$^2$.

A multilayer color photographic element B2 was prepared similar to film B1 of Example 3, but containing in the 12th blue-sensitive layer 0.017 g/m$^2$ of the yellow dye-forming DIR coupler I-1.

Magenta dye-forming coupler M-5

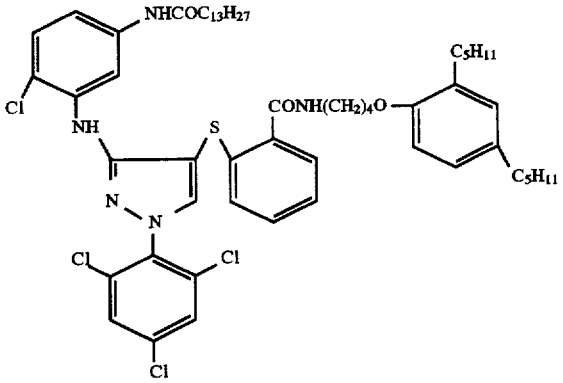

Samples of films A2 and B2 were exposed and processed as described in Example 3. For each processed sample, the characteristic curves for the blue, green and red light absorptions were obtained conventionally. The following Table 4 reports values of fog (Dmin), maximum optical density (Dmax), sensitivity in Log E at density of 0.2 above Dmin (Speed1) and toe contrast (Gamma) for the blue, green and red sensitive layers, and values of interimage effects (IIE) for the green and the red sensitive layers.

TABLE 4

| Film | Y DIR C | Layer | Dmin | Dmax | Speed1 | Gamma | IIE |
|---|---|---|---|---|---|---|---|
| A2 | Y-2 | Y | 0.82 | 2.98 | 2.51 | 0.63 | |
| | | M | 0.67 | 2.85 | 2.49 | 0.69 | 10 |
| | | Cy | 0.31 | 2.29 | 2.26 | 0.57 | 25 |
| B2 | I-1 | Y | 0.87 | 3.06 | 2.63 | 0.65 | |
| | | M | 0.74 | 2.86 | 2.62 | 0.64 | 11 |
| | | Cy | 0.31 | 2.31 | 2.31 | 0.58 | 22 |

EXAMPLE 5

A multilayer color photographic film A3 was prepared similar to film A2 of Example 4, but containing additionally in the 8th green-sensitive layer 0.066 g/m$^2$ of the magenta dye-forming coupler M-6.

A multilayer color photographic film B3 was prepared similar to film B2 of Example 4, but containing additionally in the 11th blue-sensitive layer 0.066 g/m$^2$ of the magenta dye-forming coupler M-6.

Magenta dye-forming coupler M-6

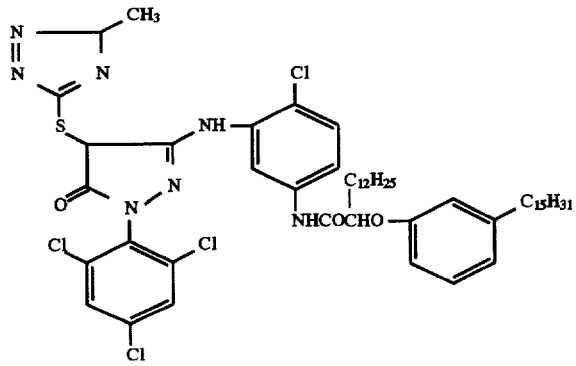

Samples of films A3 and B3 were exposed and processed as described in Example 3. For each processed sample, the characteristic curves for the blue, green and red light absorptions were obtained conventionally. The following Table 5 reports values of fog (Dmin), maximum optical density (Dmax), sensitivity in Log E at density of 0.2 above Dmin (Speed1) and toe contrast (Gamma) for the blue, green and red sensitive layers, and values of interimage effects (IIE) for the green and the red sensitive layers.

TABLE 5

| Film | Y DIR C | Layer | Dmin | Dmax | Speed1 | Gamma | IIE |
|---|---|---|---|---|---|---|---|
| A3 | Y-2 | Y | 0.83 | 2.95 | 2.51 | 0.63 | |
| | | M | 0.69 | 2.85 | 2.36 | 0.68 | 22 |
| | | Cy | 0.31 | 2.31 | 2.24 | 0.58 | 21 |
| B3 | I-1 | Y | 0.88 | 3.05 | 2.64 | 0.63 | |
| | | M | 0.72 | 2.85 | 2.46 | 0.68 | 21 |
| | | Cy | 0.31 | 2.36 | 2.32 | 0.59 | 17 |

EXAMPLE 6

Two films were prepared as described in Example 2, but using in the second blue-sensitive layer the yellow dye-forming coupler I-1 at a coverage of 120 mmol/mol Ag (Film 2) and the yellow dye-forming DIR coupler YDIR2 at a coverage of 48 mmol/mol Ag (Film 1).

Yellow dye-forming DIR coupler YDIR2 (compound no. 49 in U.S. Pat. No. 4,477,563)

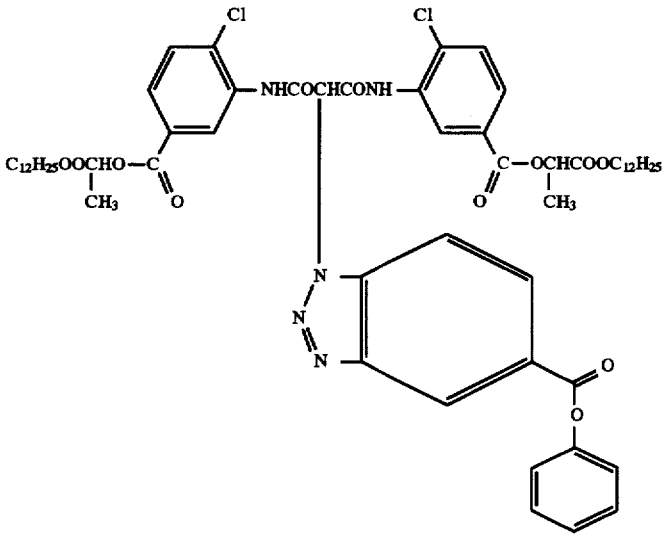

Samples of the films were exposed and processed as described in Example 2. For each processed sample, the characteristic curves for the blue and the green light absorptions were obtained conventionally. The following Table 6 reports values of sensitivity in Log E at density of 0.2 above Drain (Speed1) and 1.0 above Dmin (Speed2) and toe contrast (Gamma) for the blue and the green sensitive layer, and values of interimage effects for the green sensitive layer.

TABLE 6

| | Y DIR | Blue Sens. Layer | | | Green Sens. Layer | | | |
|---|---|---|---|---|---|---|---|---|
| Film | Coupler | Speed1 | Speed2 | Gamma | Speed1 | Speed2 | Gamma | IIE |
| 1 | Y DIR2 | 2.52 | 1.68 | 0.89 | 1.93 | 0.65 | 0.54 | 31 |
| 2 | I-1 | 2.70 | 1.97 | 1.07 | 2.17 | 0.79 | 0.50 | 48 |

We claim:

1. A multilayer color photographic element comprising a support having coated thereon red-, green-, and blue-sensitive silver halide emulsion layers comprising, respectively, cyan, magenta and yellow dye-forming couplers, wherein at least one silver halide emulsion layer comprises a yellow dye-forming DIR coupler having a 1,2,4-triazolyl group attached to the coupling position, said 1,2,4-triazoyl group comprising a benzythio group in the 3 position of said 1,2,4-triazolyl group, wherein the carbon atom in the para position relative to the carbon atom in the beta position with respect to the sulfur atom of said benzythio group contains a hydrolyzable alkoxy-or aryloxy-carbonyl group.

2. A photographic element as claimed in claim 1, wherein the yellow dye-forming DIR coupler is represented by the formula

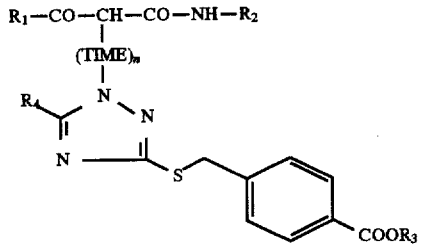

wherein $R_1$ represents an alkyl group, an aryl group or —$NHR_5$, wherein $R_5$ represents an alkyl group or an aryl group, $R_2$ represents an alkyl group or an aryl group, TIME represents a timing group, n is 0 or 1, $R_3$ represents an alkyl group or a phenyl group, and $R_4$ represents hydrogen atom or an alkyl group.

3. A photographic element as claimed in claim 1, wherein the yellow dye-forming DIR coupler is represented by the formula

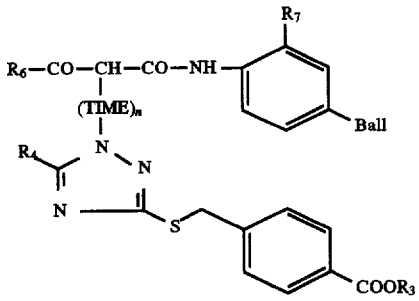

wherein

TIME represents a timing group, n is 0 or 1, $R_3$ represents an alkyl group or a phenyl group, and $R_4$ represents hydrogen atom or an alkyl group, $R_6$ represents an alkyl group or an aryl group, $R_7$ represents a halogen atom, an alkyl group or an aryl group, and Ball is a hydrophobic ballasting group.

4. A photographic element as claimed in claim 1, wherein the yellow dye-forming DIR coupler is represented by the formula

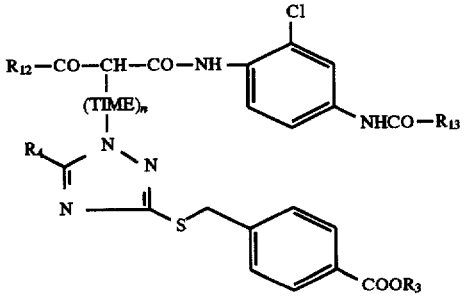

wherein

TIME represents a timing group, n is 0 or 1, $R_3$ represents an alkyl group or a phenyl group, $R_4$ represents hydrogen atom or an alkyl group, $R_{12}$ represents a branched chain alkyl group, and $R_{13}$ represents an alkyl group, a phenoxyalkyl group, an alkoxyphenyl group, or an aralkyl group.

5. A photographic element as claimed in claim 1, wherein the yellow dye-forming DIR coupler is contained in a blue-sensitive silver halide emulsion layer containing a yellow dye-forming coupler.

6. A photographic element as claimed in claim 5, wherein the yellow dye-forming coupler is represented by the formula

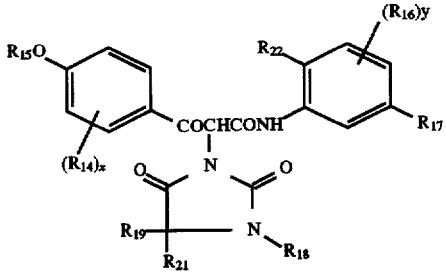

wherein $R_{14}$ and $R_{16}$, equal or different, each represents an alkyl group having 1 to 4 carbon atoms, aryl group, halogen atom or alkoxy group; x and y are individually 0, 1 or 2; $R_{18}$ is an alkyl group having 1 to 4 carbon atoms; $R_{17}$ is a hydrophobic ballasting group; $R_{18}$ represents a hydrogen atom, an alkyl group, an aryl group or an acyl group; $R_{19}$ is a hydrogen atom, an alkyl group, —O—$R_{20}$ or —S—$R_{20}$ wherein $R_{20}$ is a hydrogen atom, an alkyl group, an aryl group, a heterocyclic group bonded to the oxygen or sulfur atom through one carbon forming said heterocyclic group, or an acyl group; $R_{22}$ is a hydrogen atom, an alkyl group or an aryl group; $R_{22}$ is a halogen atom or an alkoxy group having 1 to 15 carbon atoms.

7. A photographic element as claimed in claim 5, wherein the yellow dye-forming coupler is used in an amount ranging from 0.01 to 0.5 mol per mol of silver halide, and the yellow dye-forming DIR coupler is used in an amount of 0.001 to 0.1 mol per mol of silver halide.

8. A photographic element as claimed in claim 1, wherein the yellow dye-forming DIR coupler is represented by the formula

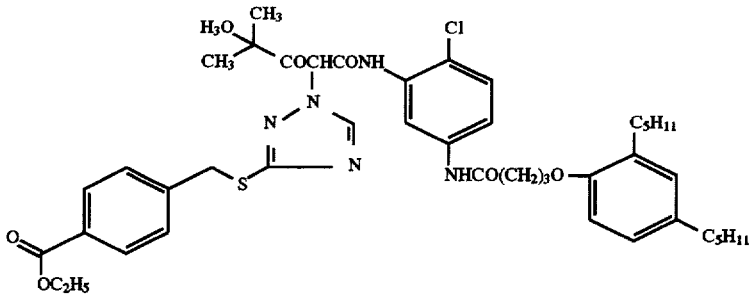

9. A photographic element as claimed in claim 5, wherein the yellow dye-forming coupler is represented by the formula

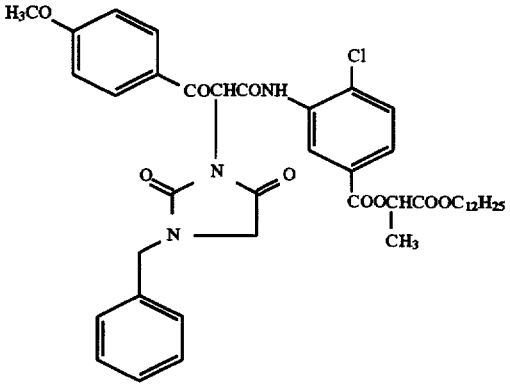

10. A photographic element as claimed in claim 1, which consists of a support comprising in the order of an antihalation layer, three layers of silver halide emulsions sensitized to red light of increasing sensitivity from the support and containing cyan dye-forming couplers, three layers of silver halide emulsions sensitized to green light of increasing sensitivity from the support and containing magenta dye-forming couplers, a yellow dye filter layer, and two layers of silver halide emulsions sensitized to blue light of increasing sensitivity from the support and containing yellow dye-forming couplers.

* * * * *